US005880853A

United States Patent [19]

Hillberg

[11] Patent Number: 5,880,853

[45] Date of Patent: Mar. 9, 1999

[54] METHOD AND DEVICE AT AN EQUIPMENT FOR TELEMESSAGES

[76] Inventor: Arne Hillberg, Ruddamsgaten 7, S-803 20 Gayle, Sweden

[21] Appl. No.: 929,107

[22] PCT Filed: Feb. 2, 1994

[86] PCT No.: PCT/SE94/00077

§ 371 Date: Aug. 1, 1995

§ 102(e) Date: Aug. 1, 1995

[87] PCT Pub. No.: WO94/18767

PCT Pub. Date: Aug. 18, 1994

Related U.S. Application Data

[63] Continuation of Ser. No. 500,892, Aug. 1, 1995.

[30] Foreign Application Priority Data

| | | | |
|---|---|---|---|
| Feb. 2, 1993 | [SE] | Sweden | 9300314 |
| Feb. 9, 1993 | [SE] | Sweden | 9300408 |
| Mar. 1, 1993 | [SE] | Sweden | 9300680 |
| Aug. 16, 1993 | [SE] | Sweden | 9302648 |

[51] Int. Cl.[6] ..... B65B 11/48

[52] U.S. Cl. ..... 358/402

[58] Field of Search ..... 358/400, 402–403, 358/498, 500; 270/58.06; 271/2; 156/441.5, 442.1–442.2

[56] References Cited

U.S. PATENT DOCUMENTS

| | | | |
|---|---|---|---|
| 4,106,060 | 8/1978 | Chapman, Jr. | 358/402 |
| 4,510,010 | 4/1985 | Schramm et al. | 156/383 |
| 5,029,429 | 7/1991 | Noma et al. | 53/120 |
| 5,123,892 | 6/1992 | Lin | 493/394 |
| 5,167,739 | 12/1992 | Hutchinson et al. | 156/64 |
| 5,301,981 | 4/1994 | Nesis | 380/54 |

FOREIGN PATENT DOCUMENTS

| | | |
|---|---|---|
| 0 378 912 A2 | 7/1990 | European Pat. Off. . |
| 3928501 | 12/1990 | Germany . |
| 61-105175 | 5/1986 | Japan . |
| 1-309568 | 12/1989 | Japan . |

OTHER PUBLICATIONS

Xerox Disclosure Journal, vol. 10, No. 4, Jul./Aug. 1995, pp. 251–252.

*Primary Examiner*—David K. Moore
*Assistant Examiner*—Stephen Brinich
*Attorney, Agent, or Firm*—Pollock, Vande Sande & Amernick

[57] ABSTRACT

An enveloping device for equipment which receives telemessages is provided. The equipment is arranged to print out the telemessages on a printout medium. Punching members and flap affecting members are arranged along three sides of the printout medium. The punching members punch out a flap in the printout medium and a recess adjacent to the flap. The flap affecting members take each outpunched flap into the adjacent recess forming a breakable closure thereby sealing the printout medium.

7 Claims, 17 Drawing Sheets

METHOD AND DEVICE AT AN EQUIPMENT FOR TELEMESSAGES

This application is a Continuation of U.S. patent application Ser. No. 08/500,892, filed Aug. 1, 1995 which is a U.S. national application of PCT/SE94/00077, filed Feb. 2, 1994.

FIELD OF THE ART

The present invention refers to a method at an equipment for sealing one or more telemessages in connection to the reception of each message respectively at a receiving apparatus. The invention also refers to a device for accomplishing the method.

The expression "telemessages" being used herein is to be considered in a broad sense. With the expression in question is here, amongst other things, included telefax messages and messages that are transferred by means of so called electronic mail etc. The receiving equipment is arranged to effectuate a printout on a printout medium that can be formed by paper or other material, at or after the reception of each message respectively. The printout can be carried out through automatical function that, for instance, takes place in connection to telefax apparatuses that can be set for automatic or manual function. Though, the printout might also take place at a wished, later time, at which the printout function can take place in accordance with manual activation through affections of keys, particularly occurring in connection to the handling of so called electronic mail. The receiving equipment comprises or is connected to a printout unit. In the case of electronic mail or the like the receiving equipment comprises, besides a printout unit, a computer, computer terminal or an equivalent apparatus.

When in the following specifically referring to the expression "telefax" it should be understood that, in the occurring cases, also such telemessages or tele equipment as have been discussed above are included.

PRIOR ART

It is known to envelop telefax messages and in the first place it has thereby been suggested to use a plastic enclosure that has been provided with an edge that can be torn off. The equipment for enveloping has been suggested to be mountable onto a certain type of telefax apparatus that has been provided in the open market to a relatively very high price (SEK 80-90 000).

DESCRIPTION OF THE INVENTION

Technical Problem

Plastic material is a polluting product that should be avoided to the largest possible extent. Enveloping in plastics in connection to telefax equipments and telefax messages, which in the future will increase substantially in extent, would bring along an unacceptable strain on the environment. Thus, in this context, there are demands for an ability to use more non-pollutant equipment and technique. The invention is concerned with solving this problem.

It is also desirable to be able to use a closing function for fax messages for a more common use, i.e. one wishes to be able to use the possibility of enveloping on a larger number of types of fax apparatuses and not only on specially adapted apparatuses. The invention also solves this problem.

It is important that the apparatus can be arranged with technically simple building components and reliable functions. Existing types of fax paper shall be employable also for the closing function. Thus, each fax paper respectively shall be able to form the envelope itself (cf. so called post cards). The upper side as well as the lower side of the enclosure/envelope shall consist of the fax paper itself. The fax paper which is foldable in one embodiment shall furthermore be closable with simple, non-polluting means according to what has been said above. The invention also solves this problem.

Alternatively the fax paper should be able to be a part of the envelope together with a separate paper or sheet fed in over the fax message within the fax apparatus or the additional equipment thereof, after which the two sheets or the papers that are at least partly covering each other, are anchored to each other with said means. The invention can solve also this problem.

At the object of the invention a joining means shall also be employable in connection to the closing of "the envelope" and thereby it is important that the means is applicable to the sections in question in the right part in the total function course for the closing and fax paper production in the machine. A distinct application function of the means is thereby a great advantage and at the use of the folding function on the fax message the application and folding functions shall be possible to adapt in relation to each other. The invention also solves this problem.

At the object of the invention a punching or treatment function of the first and second paper materials shall be effectuatable if desired, so that the closure is possible to open and after opening not possible to close without it being possible to note that the enclosure has been broken. The invention is concerned with solving this problem.

At combinations of punching and joining means functions the means shall interfere with flaps and recesses in the paper material, so that an effective and secure closure arises. The invention solves also this problem.

Activation or heat functions shall be possible to supply in the closing procedure and serve as activating agent for the joining means if the latter is used. In one embodiment heat is supplied to the paper sections in question so that the paper material (amorphous+crystaline) is crystallized and forms a hard, brittle edge, where an adhering effect exists in the material and is possibly employed in combination with mechanical joining principles (flaps, holes, seem, weld, etc.) and joining means. The invention also solves this problem.

In connection with the closing function or after that a need of establishing a perforation which facilitates the offtearing or breaking function might exist. The invention solves the problem of establishing such a perforation in a technically simple way.

At a possible employment of frames in the equipment, that press the paper parts towards each other at the edges, the frames might be designed with upwards protruding parts, e.g. pin-shaped elements, that, during the clamping of the papers between the frames, protrudes through the paper material in a perforating purpose. The invention also deals with this problem by making possible a simple perforating principle in connection to the closing function.

In connection with telefax equipment messages are often sent on a plurality of sheets. Hereby the question arises whether all of the messages are to be enveloped. The present invention also bears in mind the problem of making possible an optional enveloping from the sending apparatus and/or from the receiving apparatus. Thus a user can choose if the whole message (several fax papers) or just parts thereof shall be enveloped. In this context it is also important that transmission of messages that the sender and/or the receiver want/s to be enveloped doesn't take place without the receiving apparatus having enveloping possibilities. The lack of such an enveloping possibility might be due to the fact that the receiving apparatus lack any such equipment, that the equipment is incorrect, or that paper or enclosing means is missing in the receiving apparatus. Information referring to the aforesaid is transmitted to the sending apparatus or is indicated in the receiving apparatus. The invention also solves these problems.

The invention can also be referred to fax equipment including a first fax apparatus communicating with one or more second fax apparatuses in a telecommunication system. Thereby a first fax apparatus is equipped with an enveloping function for a fax message that thus can be received, enveloped and delivered in an enveloped state from the apparatus or an additional equipment connectable to the latter. The invention also comprises signal exchanging functions between the fax apparatuses involved. The signal exchange may consist of a protocol known per se, preferably standardised.

With this sort of fax apparatuses and fax equipment it is important that transmitting functions and enveloping functions can be co-ordinated so that, for instance, the fax message that is transmitted from a transmitting apparatus is not received and delivered in a fax apparatus that cannot provide the enveloping function on the occasion in question. It is also important to be able to indicate a signal system that makes trigging or a starting up of the enveloping function possible if the latter is desired. Likewise, it is important that the apparatus is equipped with possibilities for the choice of enveloping or not enveloping. The signal function shall be employable for different enveloping methods. Thus the signal function shall be employable for different types of enveloping functions that may comprise part courses such as punching, gluing, pressing, heating, etc.

In connection to enveloping of printout messages from apparatuses of said sort it is important to be able to obtain a unit which, from an outer point view, is flexible and light and which is easy to applicate to the printout apparatuses and fax apparatuses in question. The enveloping equipment shall be able to operate quietly so that it doesn't disturb its surroundings. A small outer volume is also important as this sort of equipment often is put onto tables and the like in homes and at offices. It is also important that the equipment that envelops the printout medium is able to operate reliably and with service intervals that don't fall short of the service intervals of the rest of the apparatuses with which it co-operates. In one embodiment it is of importance to be able to integrate fax transmission, enveloping and stamping and the present invention has as its aim to, amongst other things, solve this problem.

The Solution

The present invention refers to a system where a non-polluting enveloping of fax messages shall be able to take place. In a preferred embodiment the fax message itself is employed during the producing of the envelope or the enveloping. Hereby two main alternatives are present, one of which bears in mind that the telefax paper shall be folded and closed in or along its edges, also the upper edge. Preferably the folding is thereby accomplished so that the upper part of the lower paper part doesn't get covered by the overfolded part of the paper. On the part thus not being covered name information and other information, e.g. address information, can be arranged. This latter information is most often not of any damage as to the news but may simplify the very handling of the telefax distribution after the enveloping.

According to one aspect an embodiment according to the invention is characterised in that, during said closing, one or more first sections of a first paper material are brought into contact with one or more corresponding second sections on a second paper material, and in that members are activated for effectuating one or more breakable and after breaking not unnoticeable closures of the first and second sections between the first and second sections, said closures forming the seal.

According to another aspect a device according to the invention is characterised in that first and second paper materials are arranged with first and second sections respectively, which in connection to the receiving of the telefax message or the telefax messages are arranged to be able to bear on each other, and in that members are arranged to activate the first and second paper materials at said sections in a closing function forming the sealing and producing one or more breakable but after each breaking respectively not unnoticeable seals.

In further developments of the concept of the invention the first sections are located on one half of the fax message, preferably along the edges, and the second sections are located on the other half of the fax message, along the corresponding edges thereof. Further, second members are arranged to accomplish a folding of the fax message so that the sections or the edges become setable opposite to each other for bearing on or pressing against each other in said closing function. In a complementing or alternative embodiment the first sections are located on the telefax message and the second sections are located on a covering paper which is fully or partially projectable over the telemessage from a magazine of the apparatus in question.

In a further embodiment first means are arranged to form a folding part for the telemessage during a first function course, the telemessage being feedable or foldable around the folding part, with a first part that shall be foldable over the second part of the telemessage. Before a second function course which follows the first function course the first means is extractable, possible to fold out, etc. in a removing function before the clamping of the first and second sections on the first and second parts becomes effectuated.

The removing or extraction function may operate with telescopic function and/or a sidewards projecting function for the first means.

In one embodiment the closing function may operate with mechanical treatment functions of the first and second section, flaps and recesses being made parallel or one after the other in the first and second paper material in said mechanical treatment functions and where the flaps and the recesses become threaded into each other to form or become part of the breakable but unresetable closure. In a further embodiment, during a third function course, second means are arranged to supply the first and/or second sections with joining means which is/are activatable by means of activating means, for example heat effectuating members. The first and second paper materials are arranged to be able to crystallise at the first and second sections when exposed to activating means operating with heat (e.g. 185° C. or more) and form or participate in the closure and closures respectively at sections which are thus altered as to material properties. When employing two frames which between themselves press the first and second sections in question towards each other there can be arranged perforating members, affecting the paper material and simplifying the tearing off of the edge or the like. At said frames heat generating members can be arranged. Alternatively or as a supplement mechanical punching members can be arranged. Alternatively or as a supplement a joining means and members applying such a means can be employed. As a supplement and/or alternatively seem effectuating members and/or paper welding members might be employed.

In a further embodiment the telefax equipment is provided with signal control functions, by means of which information can be introduced as to whether each telefax message respectively or parts thereof shall be sealed or not. The signal control functions can be activatable from the transmitting apparatus and/or the receiving apparatus. The closing function or the enveloping can be integrated in an apparatus in question or form an additional equipment thereof. In the additional equipment possible magazines for covering paper might be included. In this way the additional equipment and/or the fax apparatus might be provided with two different magazines, on one hand the permanent magazine for the fax paper and on the other hand a magazine for covering paper. Furthermore members providing the joining means might be included, e.g. members for glue and the like. Furthermore said punching members, seem members, etc. might be included.

Characterising for one further embodiment of the invention is, amongst other things, that the telefax message (i.e. the paper coming from the fax apparatus with the message in question) is folded in the transverse direction at one or more locations and that, preferably, on the edges between sections of the telemessage paper that are folded over each other a joining means is arranged, said joining means being activatable in connection with the enclosing. In the embodiment the joining means may consist of glue or paste activatable at a certain pre-determined temperature, e.g. a temperature of 135°–180° C.

In an alternative embodiment of the device for enveloping telefax messages in or at a telefax apparatus a paper partially covering the telefax message is employed and is applicated on the telefax information in question in connection to or after the folding/foldings of the telemessage. The folding or foldings causes parts of the telefax message to face each other with the information of the telefax message being enclosed. Said covering paper becomes located between said parts of the telefax message. The covering paper presents a joining means arranged on each side respectively thereof, said joining means being activatable at a pre-determined temperature or by another activation in question, so that at said temperature, sealing and enveloping occurs at different sections and/or one or more edges on said parts of the telefax messages.

In one embodiment the paper partially covering the telefax message corresponds to half the message or is slightly smaller than half the message. The partially covering paper is provided with joining means along at least three of its edges on both the sides thereof. Said joining means is activatable in accordance with the aforementioned. With glue, paste, or the like, the activating takes place at a temperature which is high above room temperature, e.g. between 130–°180° C. In one embodiment a paper magazine is arranged for paper with activatable joining means on both sides. Thereby strips or pieces of a different appearance are arranged to be possible to be cut off from each paper respectively and are applicable between parts of the telefax paper directed towards each other after folding.

In a further alternative embodiment for a device according to the invention, magazines are arranged for strips or differently shaped paper pieces with an activatable joining means on both sides. The strips or pieces are applied between parts of the telefax message directed towards each other after the folding.

In a further alternative embodiment for enveloping or enclosing a telefax message in or at a telefax apparatus and where joining means is employed in the form of strips or differently shaped pieces having joining means on one side only, the strip or the piece is arranged with a through recess, so that, during activation at a certain temperature, means, glue, etc. passes through each recess respectively to the side not being provided with the means, glue, etc. and effectuates adhesive (gluing, pasting) effect between the latter side and the folded part in question of the telefax message.

In a further alternative embodiment the message is folded into three parts, the two parts comprising the information on the telefax message being directed towards each other and the third part having common, not secret information or information classified as secret, such as name of the receiver of the message and the address of the same.

The invention shall also lead to a new way of thinking within the handling of post. In e.g. express parcels by postage, the letters in question are sent physically long distances (car, train, aeroplane, etc.) to collecting places, from where the distribution takes place by means of conventional mail delivery service. According to the present invention the message transmission shall be possible to take place via the telecommunication network, at least over longer geographical distances, (compare for example with parcels from Sweden to Australia, USA, etc.). The parcel in question will thereby be sent through the telecommunication network from Sweden to a collecting place in the other country, where the mail delivery service can take place in a conventional way. In this way one would be able to hand in an original, e.g. through normal letter deposition via letter box or directly, which original is employed for fax transmission or the like from the post office of the own country. The fax or the like may thereby reach another country without any loss of time and in a sealed state and be distributed in a conventional way in the other country, the time for a long physical distribution having been eliminated.

In one embodiment a mechanical sealing is to take place, while in other cases the seal may be supplemented or replaced by pasting/glue etc.

In accordance with the present invention the printout unit will comprise or be connected to the unit enveloping the printout medium and being arranged to employ a part of or the complete printout medium in the enveloping enclosure. The enveloping unit is arranged to seal the printout medium on one or more edges thereof. The printout medium is feedable to and/or in affecting members effectuating the sealing of the printout medium via the edges thereof.

In one embodiment of the invention the enveloping device comprises first feeding members driven by a first feeding arrangement, for feeding of first parts of the printout medium. The enveloping unit further comprises members affecting the printout medium for folding, which members get into function when said first parts of the printout medium have been fed forward to the members. Said affecting members may present an edge or a lip, extending over the most substantial parts of the width of the printout medium. The edge or lip gets into co-operation with the printout medium in an affecting direction that is preferably angled, preferably approximately 90° in relation to the feeding direction of the printout medium. The movement of the affecting member can be made short (15–25 millimetres), which is of importance as to space. During the co-operation with the printout medium the affecting member presses said printout medium, with the section thereof co-operating with the member, between a pair of rolls, pulleys, wheels, etc. The feeding of the printout medium by means of the first feeding arrangement causes further feeding of the initiated folding, which, by way of example, can be accomplished on the generally intermediate parts of the printout medium. The equipment may be arranged to accomplish folding at different parts of the medium. The further feeding takes place towards a second feeding arrangement. The member and the feeding arrangements co-operate with the printout medium along the most substantial parts of the width thereof. In one embodiment the second feeding arrangement can direct the initiated folding of the printout medium towards the members affecting the edges of the printout medium. The latter members may comprise punching members and flap affecting members arranged along preferably three of the edges of the folded printout medium, said edges thereby possibly being formed by a front edge and the side edges. Alternatively or as a supplement the affecting members may comprise equipment for clamping, gluing, etc. the edges of the folded parts against each other.

In one embodiment the punching and the flap affecting members are chosen in a number assuring an appropriate closing of the folded printout medium, in accordance with its application area of use. Said punching and flap affecting members may be 5–25, preferably 10–15, as to their number, with printout medium in A4-size.

In one further embodiment each punching member respectively is provided with a first punching member or punching function arranged to accomplish a medium flap or medium flaps during its function and a second punching function arranged to accomplish a recess arranged by the side of the recess for the flap or with the flap, at the activation thereof. The flap/s may thereby be retained via an edge or end thereof. During their function, the flap affecting members are arranged to accomplish insertion of each outpunched flap or pair of flaps respectively in the adjacent recess, so that the flap or pair of flaps are taken up into the adjacent recess via the bottom side of the printout medium, preferably via its or their ends. In one embodiment a knife or punch make part of the flap affecting member and punches the adjacent recess and is provided with a recess into which the flaps are pressed by means of inserting members. The flaps are pulled through the adjacent recess during the upward movement of the knife of punch. Also stripping members are included. Each flap respectively will thereby extend from the bottom side of the printout medium via its belonging recess and to the upper side of the printout medium at the adjacent recess. Further the punching members might be arranged in holders, e.g. comprising two parts that are generally parallel arranged and that support the punching and flap affecting members. Thereby the function of the latters can be coordinated through movements of the holders, so that the punching and the flap affection is effectuated when the holders are moving towards each other. Preferably or by way of example the holders are operated with an eccentric function which accomplishes the movements of the holders.

Sensors are being employed for controlling said functions. Thus, a first sensor is employed, which detects where pre-determined parts of the printout medium have been infed to or with a pre-determined length. When the sensor detects the edge of the printout medium it causes initiating of the affecting member, which thereby gets into co-operation for said folding function. Furthermore, a second sensor can be employed, which detect when the folded sections have reached a certain location or position in the affecting member, or between said holders. As the second sensor is activated said function and flap affecting movements are initiated. Sensors for controlling position for folding are also included. One or more of the sensor functions can be integrated. In a possible embodiment the printout medium is provided with a marking that might be formed by a bar code, or another sort of marking, which is detectable by means of equipment which may comprise or be formed by a third sensor. In accordance with the detection, the latter member controls the enveloping equipment so that it envelops the printout message. Also the position of the folding on the medium might be determined. Printout media (paper) with such a marking are thus in advance put into the printout apparatus in question (fax apparatus, printing equipment, etc.). The folding may be effectuated in such a way that a remaining part is left open for the reading from outside. The remaining part or space can be provided with a stamp, address, remitter, receiver, identification, code for enveloping, etc.

The invention also comprises a system with devices of the described sort. One or more such devices with enveloping function may be set up or arranged in a post office or a post supplying office, e.g. within larger companies, units, etc. Thereby a customer can address himself to an office in question to have an enveloped message transmitted. Thereby the message can be transferred from the first office to another post office or post supplying office, which, by way of example, might be located in another country, be constituted by a larger company, etc. The device at the first office may be operatable by personnel at the office or by the customer himself. In the latter case, the device may for instance be arranged for common use. The personnel may receive the original that is to be faxed through ordinary postal service or personally. In this way, the message in question can be transferred in great secrecy through the telecommunication network a first geographical distance and then be distributed from the second office in a conventional way, known per se, a second geographical distance. The offices may provide pre-printed or pre-preparated printout media, preferably printout media provided with stamps, spaces for addresses, code or marking for enveloping, etc.

Through the invention a new product can also be presented, namely a product being effectuated by means of printout equipment for fax messages and/or messages through electronic mail, etc. The product is characterised in that the printout message has the form of an enveloped message. The enveloping takes place in accordance with a control which tells if enveloping shall be present or not.

Advantages

By means of the equipment suggested in the aforementioned and the method accordingly associated thereto an attractive closing function which is non-polluting is now obtained. The principles for the execution of the invention can be carried out with known standard elements and known standard functions. The folding function in the apparatus, if employed, can be made relatively simply as well as the arranging of the additional magazine, which is needed for the employment of covering papers. The fax paper and possible covering paper are thereby being arranged so that the information on the fax paper doesn't become readable from the outside. In this way the fax message or the fax messages doesn't/don't become accessible (readable) for anybody in the presence the apparatuses in question. This can be a great advantage at different companies, post offices etc. employing apparatuses for several users.

DESCRIPTION OF THE DRAWINGS

The presently suggested embodiments for a method and a device according to the invention will be described in the following, with simultaneous reference to the enclosed drawings, in which.

EMBODIMENTS ACCORDING TO THE FIGS. 1–22

Figure 2:
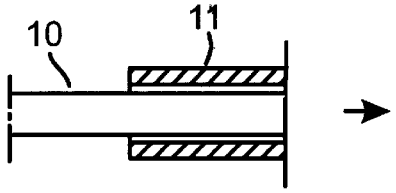
FIG. 2 shows an embodiment of a folding part in a lengthwise section, included in the equipment of FIG. 1.

A known fax apparatus of the sort that might be present on the market is shown with 1. It is built with or provided with an additional equipment 2 for the enclosing of faxmessages 3. With enclosing is hereby meant that the whole or parts of the text, figure or other information on the fax message shall be possible to cover before it leaves the apparatus 1, 2. The message or the messages shall thus not be possible to be read by any unauthorized but shall leave the apparatus in an "enveloped" stage. In one embodiment the fax itself shall form the envelope by being folded and closed along its complete or parts of its edges. Thereby the folding apparatus 4 is arranged in the casing 5 of the additional equipment. An enveloped message is shown with 6 and is on its way out from the apparatus in the direction of the arrow 7. The holding takes place around a part 8 that can take two positions, the second position, forming a side displacement position, being shown with 8'. A member (e.g. a motor with our without linking, gear wheels etc.) operating the movements of the folding member is shown with 9. According to FIG. 2 the folding part may alternatively or as a supplement be telescopic and operate with retracting and projecting movements for a part 10 in relation to a part 11 which in its turn can be telescopically arranged in relation to another part (not shown), etc. The manoeuvring of the folding part is necessary as the paper 3 being folded around the part 8 is to be closed along its edges in accordance with the following.

Figure 3:
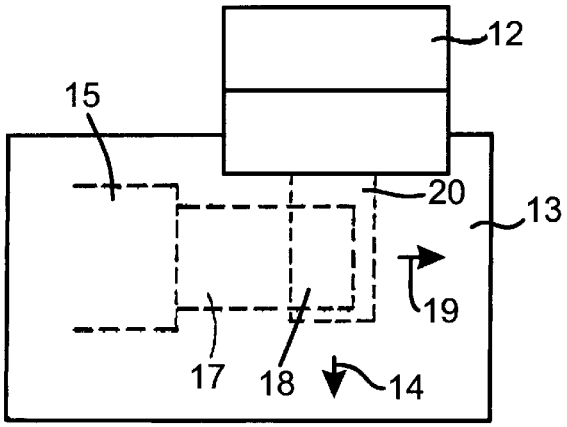
FIG. 3 is showing a conventional fax apparatus in a horizontal view, with an additional equipment according to a second embodiment in relation to the embodiment according to FIG. 1.

In FIG. 3 a conventional telefax apparatus is shown with 1 and is connected or connectable to an enveloping part 13 comprising a magazine 15 which is arranged at the side, over or under the outlet path 14 for a fax being fed out from the apparatus 12, the magazine 15 being meant for covering papers 17, 18 which are feedable in a transverse direction 19 over the fax 20 fed from the fax apparatus 12. The paper in question may be included in magazines above the feeding path 18 for the fax and is thereby able to fall down due to its own weight. The covering paper covers the telefax paper 20 completely or partially and the two papers 18, 20 form an envelope together when they have been joined in accordance with the following.

Thereby the information on the paper 20 is turned towards the bottom side of the covering paper so that the information can't be read by any unauthorized person from outside the envelope.

Figure 4:
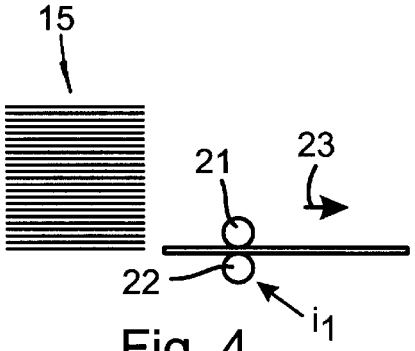
FIG. 4 is showing a second magazine for covering paper, in a side view, employed in connection to the embodiment according to FIG. 3.
Figure 5:
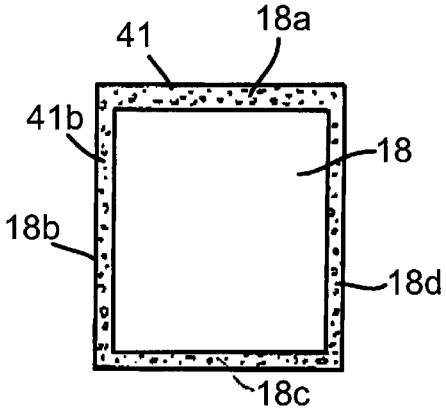
FIG. 5 is showing the design of a covering paper in a horizontal view.

FIG. 4 shows the paper magazine 15 from the side and in the present case the covering papers are pre-sheared or pre-cut and laid upon each other. The outfeeding members 21, 22 are arranged to outfeed the covering papers one at a time in the direction of the arrow 23, over the fax paper in question. Outfeeding and control may occur in an known way. A control signal for activating and stopping the outfeeding members 21, 22 is symbolised with i1. According to FIG. 5 each covering paper respectively can be arranged with sections 18*a*, 18*b*, 18*c*, 18*d* that are pre-preparated with joining means (e.g. glue) or pre-treated in a mechanical or chemical way.

Figure 6:
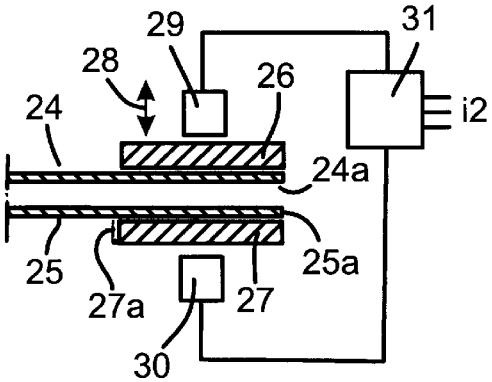
FIG. 6 is showing means for compressing of first and second sections on first and second paper materials and belonging activating material.

In FIG. 6 two paper materials are represented with 24 and 25 respectively. The first material has first sections 24*a* and the second material second sections 25*a*. In the present case two frames 26 and 27 are employed, said frames extending around the peripheral edges of the papers and covering said sections 24*a* and 25*a* respectively. Said frames are arranged to take two different positions, of which the first position is shown in FIG. 6. In a second position the frames are affected in a direction towards each other and are bearing on each other with said section 24*a* and 25*a* inbetween. Depending on if a joining means has been arranged between the section 24*a* and 25*a* activating members 29, 30, 31 are employed. These activating members may consist of members generating infrared radiation, heat affecting members, etc. A control unit 31 makes part of the equipment and this control unit is affected by other signals, here indicated with i2. The control of the frames in relation to each other in the directions of the arrows 28 may be accomplished in a way known per se with functions known per se. In the opened position the fax paper 25 can be infed between the frames during its outfeeding from the fax apparatus (cf. 1 in FIG. 1). In a corresponding way the second paper or the covering paper 24 can be infed between the frames in the transverse direction.

Figure 7:
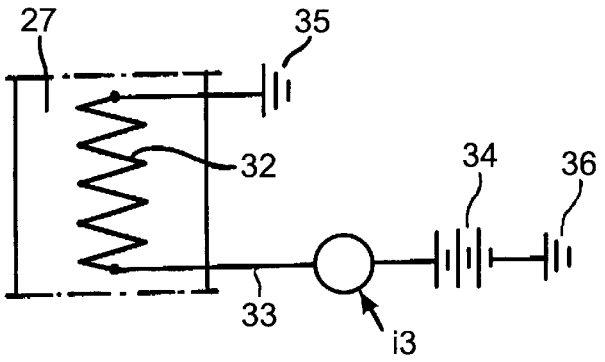
FIG. 7 is showing an electric heat coil for heating a pressing part, for instance the one shown in FIG. 6.

In FIG. 7. is shown an embodiment in which heat coils 32 may be arranged in either of or both of said frames 26, 27. The heat coils are activatable by means of a signal i3 which forms a contact element in an electric circuit 33 connected to a battery 34 and an earth arrangement 35, 36.

Figure 8:
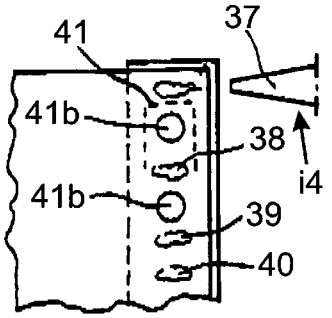
FIG. 8 is showing, in a horizontal view, parts of members that are applying joining means, in connection to first sections on a first paper material.

FIG. 8 shows applying members 37 for joining means 38 which can be applied spotwise (cf. also the reference symbols 39, 40) or stringwise. In this case the applying takes place on the upper side of the fax message (cf. the upper side of the paper 25 of FIG. 6). The open frames can make such an application possible. In such a case it might be necessary to apply an air suction function to the covering paper 24. Such an air suction function seeks to maintain the distance between the papers 24, 25 according to the figure. The air suction function can be considered to be represented by the unit 29, which affects the air through gaps or recesses at the upper frame 26.

Figure 9:
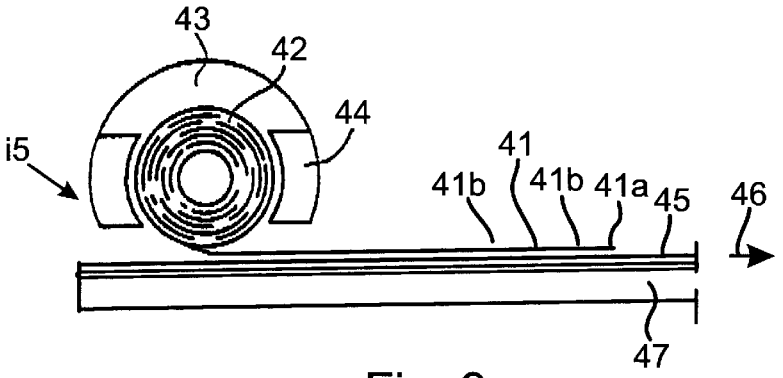
FIG. 9 is showing, in a side view, an applying principle for joining means on first sections on a paper material.

In FIG. 9 a joining means 41 is applied from a roll 42 which is arranged in an arrangement 43 carrying said roll, and the outfeeding of the roll may occur in an active way, e.g. by means of a motor 44. Alternatively the front end 41*a* might be pressed down towards the upper side of the fax paper 45, in the point 41A. During the continued outfeeding of the fax paper in the direction of the arrow 46 a joining means 41 is rolled off from the roll 42 which thereby can rotate due to the feeding force of the fax paper 45. In this case the bottom frame is indicated with 47. In a preferred embodiment the means 41 can be perforated with through holes 41*b*. As to the extent of the means 41 and the positions of the holes 41*b*, these also have been shown in the FIGS. 5 and 11 (within dashed lines) for the sake of clearness.

Figure 1:
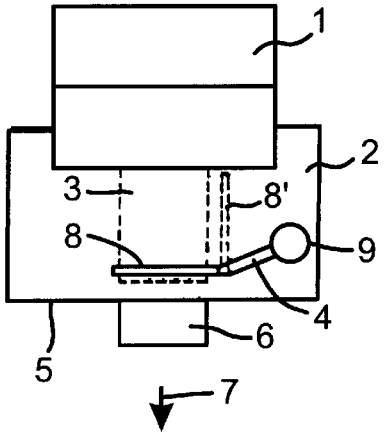
FIG. 1 shows a conventional fax apparatus in a horizontal view, provided with an additional equipment for enveloping in accordance with the invention.
Figure 10:
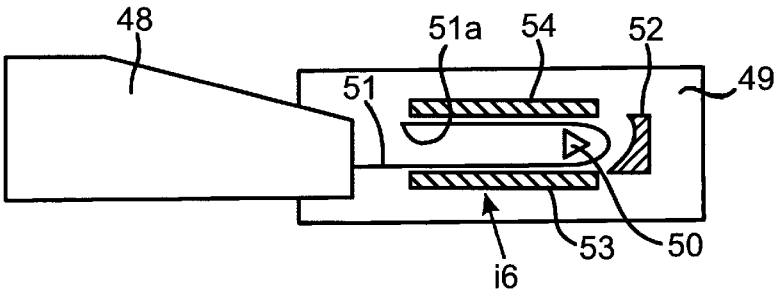
FIG. 10 is a side view showing a fax apparatus with a closing part operating with the folding principle for the paper.

In FIG. 10 a fax is indicated with 48 and this fax apparatus might be formed by an apparatus known per se. To this apparatus an additional equipment according to the invention is connected in a way known per se. FIG. 1 is also referred to. In this case the folding function is employed and the fold part 50 can present a relatively sharp lip to give a distinct fold on the enveloped message 51, which in this case is formed by a folded fax paper. The guiding and the infeeding of the free end 51*a* of the outfed fax paper may occur in a way known per se and with known means. The figure shows a directing member 52. Furthermore an underlay part 53, which may be formed by a frame in accordance with the aforesaid, and an upper part 54 are included. The parts 53 and 54 can be arranged so that they can be pressed towards each other (when the folded part 50 has been withdrawn). The controlling of the parts 53 and 54 is symbolised with a control signal i6.

Figure 11:
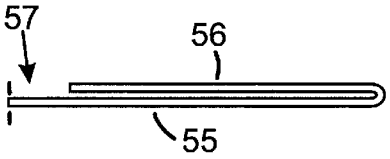
FIG. 11 is a side view showing an enveloped message consisting of a folded telefax paper.

FIG. 11 shows the folded fax paper according to FIG. 10. The lower part of the fax paper is indicated with 55 and the upper part with 56. As it appears from the figure the part 55 is only partially covered by the part 56, so that a space 57 is left open for names, addresses, etc.

Figure 12:
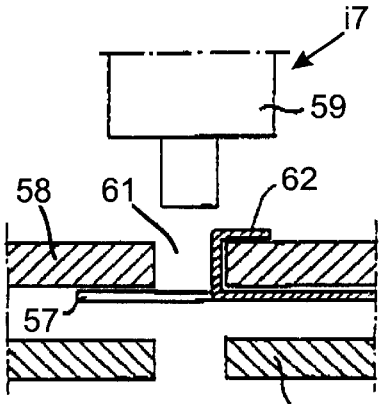
FIG. 12 is a cross-section showing punching members in additional equipment.

FIG. 12 shows a punching function which can be used at the additional equipment, for mechanical treatment of the fax paper 57 and the overfolded or overlapped paper part 58. By means of the punching function which is symbolised by means of a punch 59 and a die 60 holes 61 and flaps 62 can be produced in the paper material 58, 57. Thereby, the punching can be executed in such a way that the paper flaps and the holes are threaded together in connection to the mechanical treatment. In the shown case a flap 62 has been arranged so that it extends through the recess 61 and up on the upper side of the material 58. The punch and the die 59 and 60 may in principle change places. The figure is meant to show only the principle for the interleaving of the flaps and the holes and not the very punching function.

Figure 13:
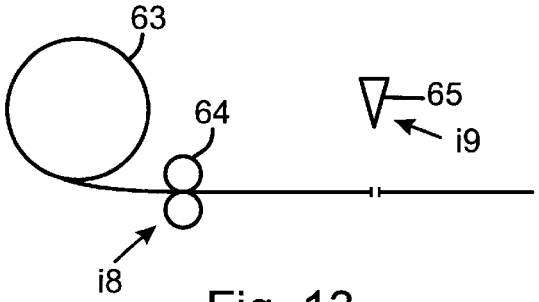
FIG. 13 is showing an alternative embodiment of the equipment according to FIG. 4 where the covering paper is fed from a roll and cut in a known way by means of cutters.

FIG. 13 shows an alternative embodiment of the paper magazine according to FIG. 4. In this case the covering papers are present on a telefax paper roll 63. The feeding members 64 are arranged to be possible to control in a way known per se. Furthermore a shearing function is symbolised with 65. Control signals i5–i9 for the equipments described above symbolise the control functions in question.

Figure 14:
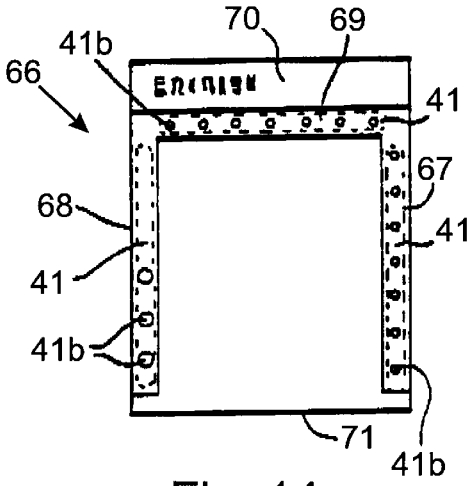
FIG. 14 is a horizontal view from above, showing the design of an enveloped message according to FIG. 11, where an upper space isn't covered and may be filled with name, address, etc. for the receiver of the message.

FIG. 14 is meant to show the fax paper according to FIG. 11 from above. Here the fax paper is indicated with 66 and edges, with which or through which joining occurs, have been symbolised with 67, 68 and 69. The free space for name, address, etc. has been symbolised with 70. At the fold edge 71 no particular joining means or treatment is needed.

Figure 15:
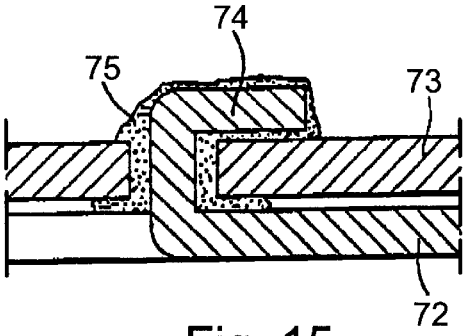
FIG. 15 is showing a combined joining principle with punched flaps and recesses in the first and second sections of the paper materials and where also the joint has been supplied with joining means.

In FIG. 15 a fax paper is indicated with 72 and an overlapping paper or covering paper is indicated with 73. The flap is indicated with 74 and in the recess for the flap a joining means 75 in the form of glue or the like is arranged. This glue has, in accordance with the aforesaid, been activated in connection to compressing of the papers 72 and 73. Similar to the aforesaid, joining means can be of the sort that is activated above a pre-determined number of degrees, e.g. 70°–80° C. Thereby the papers behave like normal papers at normal temperature and the joining means doesn't adhere or disturb the function course. At applying the number of degrees in question the glue melts and gets into a joining action for the papers 72, 73 and the flaps 74.

Figure 16:
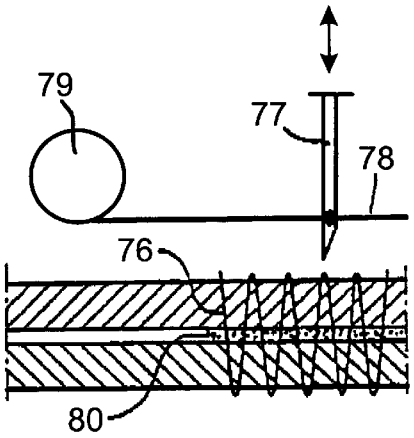
FIG. 16 is a side view showing a seem function at the first and second sections.
Figure 17:
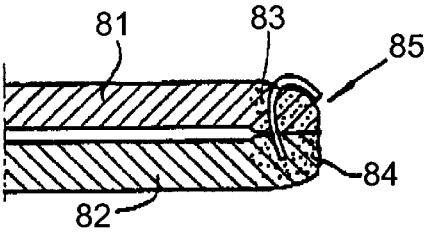
FIG. 17 is showing a joining method with property changing functions in the first and second paper materials.
Figure 18:
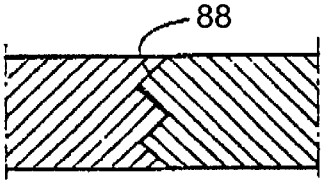
FIG. 18 is showing an alternative design of flaps between first and second paper materials.
Figure 19:
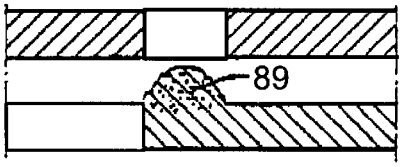
FIG. 19 is showing an alternative embodiment of out-punched flaps.

As a supplement or alternatively, in accordance with FIG. 16, a seem 76 can be employed. The applying of the seem is done by means of needle members 77 in a way known per se. An employed thread 78 is received from a thread magazine 79. Probably this method can be supplemented with joining means 80. A further alternative is shown in FIG. 17. Thereby the covering paper part or covering paper 81 and the fax paper 82 have their first sections 83 and 84 respectively subjected to heat which goes above or is within the interval 185° C. or higher. As normal fax paper is presumed to be employed in the fax apparatuses in question crystallisation will occur in the paper material and a hard and brittle edge is formed in connection to said first and second sections. This brittle edge can be interleaved and a certain fusion of the material occurs and the joining can be supplemented with a possible joining means. In the FIGS. 18 and 19 further embodiments of the result of the mechanical treatment function are shown. Thereby flaps 88 and 89 of another kind than the ones described above can be formed. Also the flap according to the FIGS. 18 and 19 can be supplemented by joining means and other mechanical joining methods.

Figure 20:
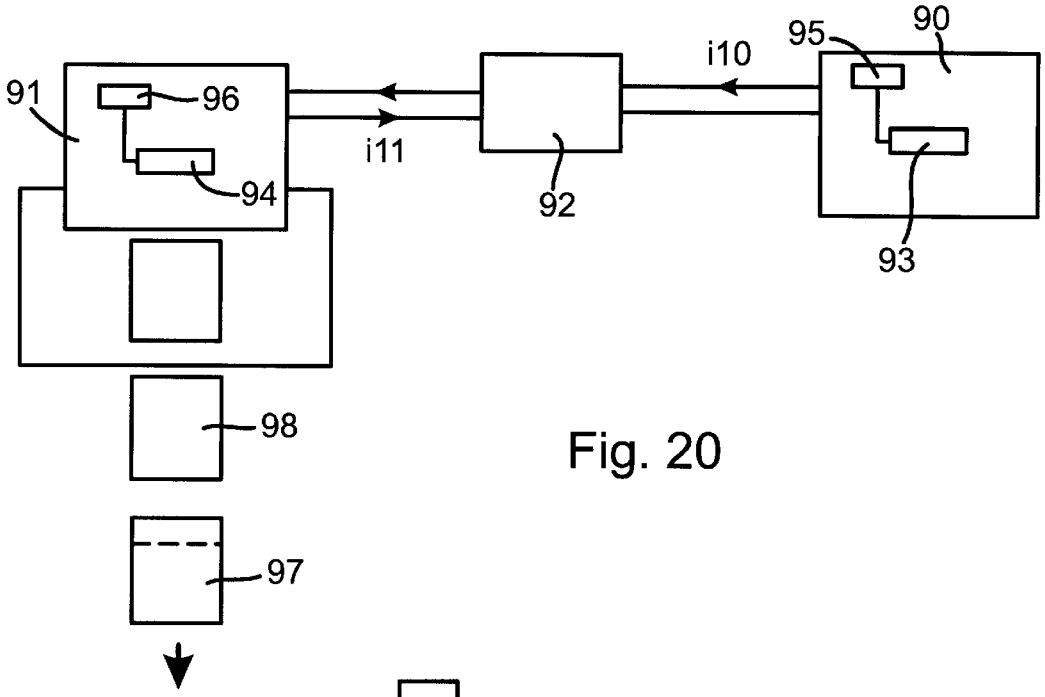
FIG. 20 shows, in a schematic form, signal transfers between the different fax apparatuses in a fax equipment.

In FIG. 20 the signal relationship between a transmitting fax apparatus 90 and a receiving fax apparatus 91 is shown. In the figure a transferring medium (the telecommunication network) has been symbolised with 92. Each apparatus respectively is provided with an operation table 93 and 94 respectively and each apparatus respectively is provided with members for said control. Said members have been indicated with 95 and 96 respectively. By means of said operation members and control members 93, 95 and 94, 96 respectively information can be introduced in the system as to whether enveloping is required to be present or not. In this way the transmitting apparatus can tell the receiving apparatus that enveloping is to take place.

Figure 21:
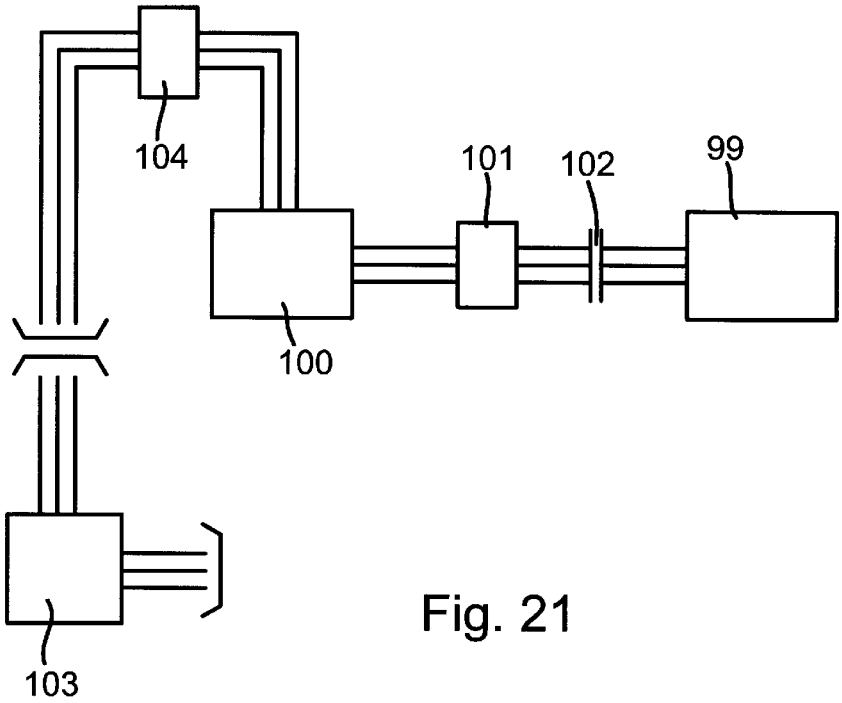
FIG. 21 is showing an equipment for control signal information within the fax apparatus equipment.
Figure 22:
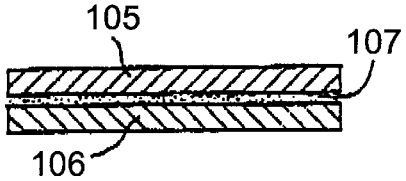
FIG. 22 shows, in a side view, joining by means of a joining means (glue)

In the same way the receiving apparatus can tell the transmitting apparatus if enveloping possibilities are present or not. On his receiving apparatus the receiver can also determine whether enveloping is to take place or not. This signalling i10, i11 may occur in a way known per se by means of known means. At the receiving apparatus are shown a number of telefaxes leaving the apparatus. The first fax in the figure has been indicated with 97 and hereby the in 25 formation has been such that enveloping of this first fax is to take place. On the other hand, the second fax 98 in the transmission is not to be enveloped, etc. In FIG. 21 the transmitting apparatus has been indicated with 99 and the receiving one with 100. The receiving apparatus is formed with adapter circuits 101 for signalling towards the line 102. Likewise it receives signals from the transmitting apparatus via the adapter unit 101. In this way information can reach the apparatus 100 from the apparatus 99 or be put in at the apparatus 100 as to whether the additional equipment is to be upconnected or not for the message in question. This information is transferred to a control unit 104 which, in its turn, generates signals to the connecting units 103 in the additional equipment. The connecting units 103 activate and determine the signals i1–i9 according to aforesaid. In FIG. 22 joining means 107 is used for the sections 105 and 106 respectively.

In the embodiment of FIG. 6 upwards projecting members 27*a* can be employed on the frame 27 and/or the frame 26.

Said upwards projecting parts or thorns penetrate into the fax paper material and/or into the paper material 24 and produce a perforation that facilitates the removal of the joined edge or the joined edges. In the embodiment of FIG. 9 pre-perforations in the joining means 41 are employed. Said pre-perforations are arranged at certain distances in the lengthwise direction of the material or means and have been indicated with 41*b*. In the case that covering paper is being employed the latter can be provided with joining means 41 and said pre-perforations 41*b*. During enveloping according to the FIGS. 11 and 14 it may be suitable to employ two addresses on the message, one visible, in accordance with FIG. 14 and one which is covered by the overlapping part 56. This so that the information in question shall remain on the fax when the edge or the envelope is torn off along the joint 69. As a joining means thermoplastic films of a sort known per se can be employed. Thermoplastic can be activated by means of heat or solvents. The heat activation is in accordance to temperature, time or pressure. The activation method can be formed by a "flat iron principle" or heat pressing accomplished by means of said frames 26, 27. There might be referred to 3M thermoplastic film of the type SCOTCH No. 584/588. Corresponding thermoplastic films can be employed. In FIG. 10 the folding of the front page of the fax message takes place over the rear edge of the fax message. Of course arrangements where the rear edge is folded over the front edge can be arranged. In this case it is suitable to provide the front edge with a thermoplastic film if a such one is employed. The method comprises that the telefax message is fed and is folded via the front edge or the rear edge over the rear and front parts respectively of the fax message. The applying of joining means may have taken place at an earlier stage or after the folding when the parts covering each other are located at a distance from each other (cf. with FIG. 10). After the applying of joining means the compressing of the parts 53 and 54 takes place with the fax message parts positioned inbetween.

EMBODIMENTS ACCORDING TO THE FIGS. 23–34

Figure 23:
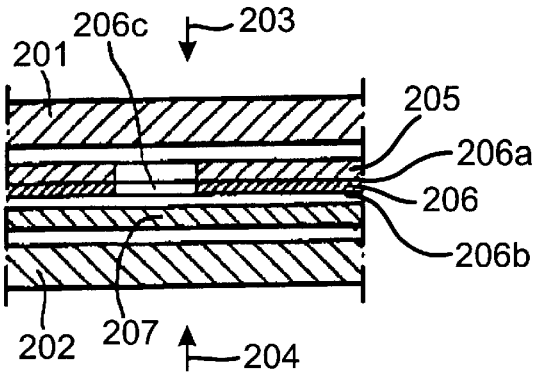
FIGS. 23–24 are showing different function courses of message enclosing by means of tape which only has glue or the like on one side.
Figure 24:
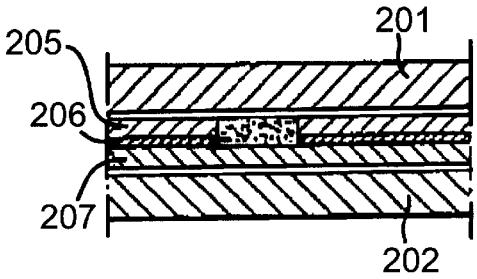

In FIG. 23 two frames that are movably arranged towards each other and for instance made of metal are indicated with 201 and 202. The moving directions of the frames are indicated with the arrows 203 and 204. Between the frames, during the function stage in question, a fax paper or fax paper part 205 is present or inserted, said fax paper or fax paper part being pasted with a strip on one of the sides thereof, said strip having glue only on one side 206*a* thereof and no glue on the other side 206*b* thereof. The sticking of the strip can occur in a stage before the function stage shown in FIG. 23. The strip 206 presents one or more through recesses that have been arranged (along the lengthwise direction thereof) and are thus conducting between the sides 206*a* and 206*b*. A fax paper part or a part or paper that is joinable with the fax paper 205 is indicated with 207. In FIG. 24 the frames 201 and 202 are compressed with the papers 205 and 207 positioned towards each other with the layer 206 in a position between the paper parts 205 and 207. Said layer has been activated, e.g. by means of heat at a temperature between 130°–180° C. This has meant that glue from the layer side 206*a* has floated out via the recess or recesses 206*c* and has forced its way out over the layer side 206*b*. This, in its turn, means that the glue, paste or corresponding on the side 206*a* also is employed to keep the outer surface 206*b* of the layer 206 and the paper or the paper part 207 together.

Figure 25:
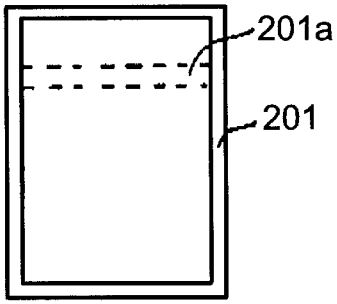
FIGS. 25–25*a* are showing examples of the design of a frame.
Figure 25A:
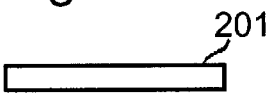

The FIGS. 25 and 25*a* show the constitution of the frames 201 and 202 respectively of the FIGS. 23 and 24. The frame can be made of metal, an alloy or some other heatable material. The heating can be done in the way already indicated. The heating can be turned on when the frames take the position shown in FIG. 24, and the heating results in the glue or the like being activated or melted and being able to start its adhering function. When the frames once again are separated the glue or the like cools down and is activated.

Figure 26:
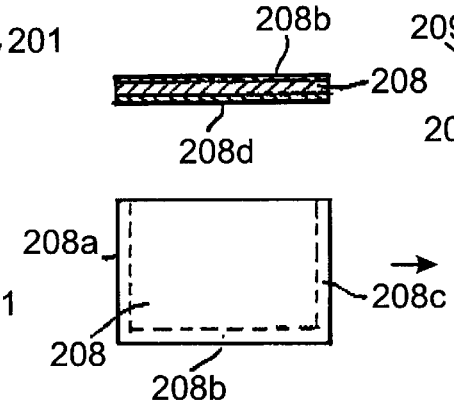
FIGS. 26–26*a* show, in a horizontal view, the fax message and a paper partially covering the fax message, and the vertical section of the covering paper.
Figure 26A:
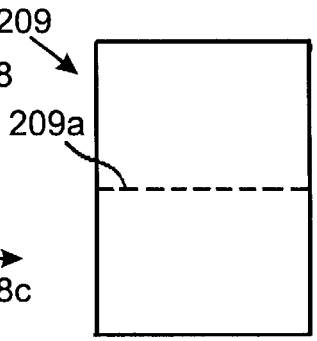

In FIG. 26 a covering paper 208 corresponding to half the size of the telefax message 209 is shown (cf. the dashed edge 209*a*). Alternatively the covering paper 208 may cover slightly less than half the paper 209. The latter paper is folded around the line 209*a* which forms a transverse direction on the paper. In this way, the telefax message 209 is folded in its transverse direction. At least at its edges a, b and c the covering paper 208 presents joining means on both sides. In FIG. 26*a* the joining means are indicated with 208*b* and 208*d*.

Figure 27:
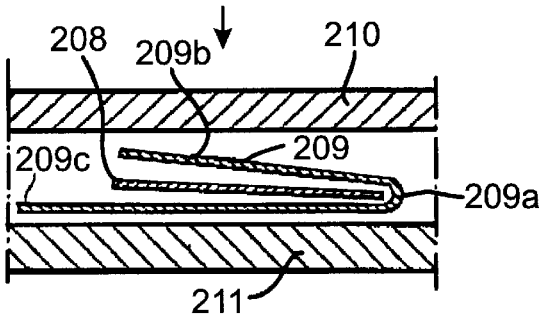
FIGS. 27–27*a* are showing two different function courses of an enveloping method.
Figure 27A:
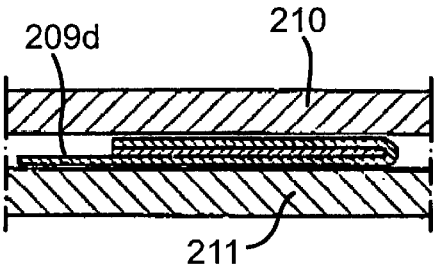

In the FIGS. 27 and 27*a* metal frames 210 and 211 are employed in accordance with the frames of FIG. 25. In the shown function courses of the FIGS. 27 and 27*a* the fax message according to FIG. 26 is folded around the line 209*a*. The covering paper 208 is inserted between the folded parts 209*b* and 209*c*. The application between these parts can occur in connection the folding or after the folding. FIG. 27*a* shows the completed folding. When the frames 210 and 211 take the position shown in FIG. 27*a* heat is activated, which means that the glue layers or the like 208*b*, 208*d* (see FIG. 26*a*) are activated. In the embodiment of FIG. 27*a* the frame 210 can present an extra cross bar for the free end of the part 209*b* of the telefax message (cf. with 201*a* in FIG. 25). The heat activation leads to a sealing occurring along all the edges (the three free edges) on the telefax message. The space 209*d* on or at the free end of the part 209*c* of the telefax message can be employed for said name and address function.

Figure 28:
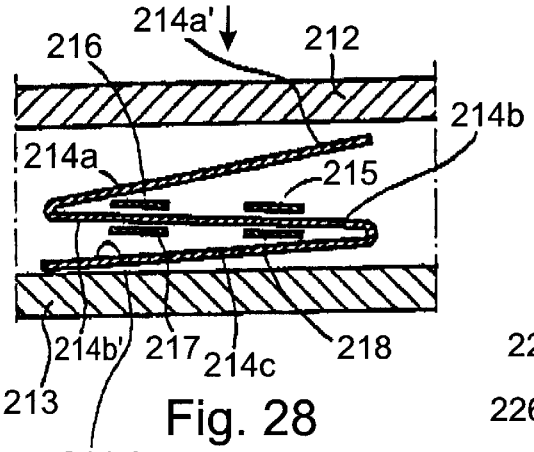
FIG. 28 shows, in a vertical view, a further embodiment of an enveloping course.
Figure 30:
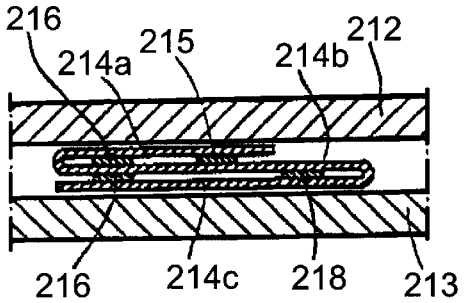
FIG. 30 shows, in a vertical view, another function stage of the function stage according to FIG. 6, where one folding part (upper folding part) of the message has been made relatively smaller.
Figure 31:
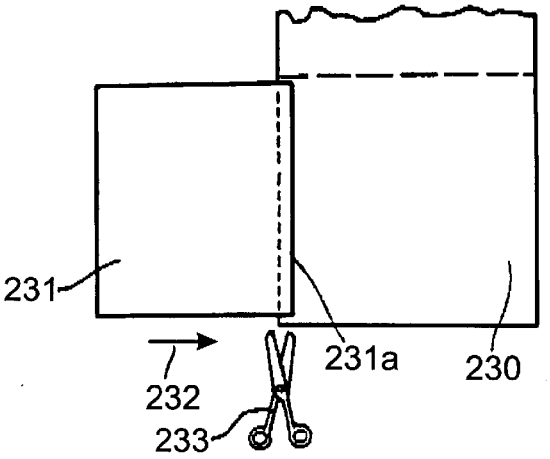
FIG. 31 shows, in a horizontal view, paper with glue or the like on both sides, said paper being only partially overlappable in relation to the telefax message and being cutably arranged at that partial overlapping to accomplish a thin strip along one edge of the telefax message, said thin strip having glue or the like on both sides thereof.

Also in the embodiment of FIG. 28 two frames 212, 213 are employed. In this case the telefax message is folded into three parts 214*a*, 214*b* and 214*c*. The information classed as secret of the telefax message is located on the sides 214*b*' and 214*c*'. The surface 214*a*' may be left open for the information not being classed as secret. Between the parts 214*a* and 214*b* and 214*b* and 214*c* respectively strips or pieces 215, 216 and 217, 218 respectively are arranged. Said pieces are located at the edges of the parts 214*a*, 214*b* and 214*c*. The parts have activatable joining means on both sides thereof. In the embodiment of FIG. 30 the frames 212 and 213 are pressed towards each other with said fax message pages, 214*a*, 214*b* and 214*c* positioned inbetween. Furthermore, the pieces 215, 216 and 217, 218 respectively are clamped against their belonging fax message parts. The heat activation leads to the activation of the adhering procedure and the fax message parts are held together in the configuration shown in FIG. 30.

Figure 29:
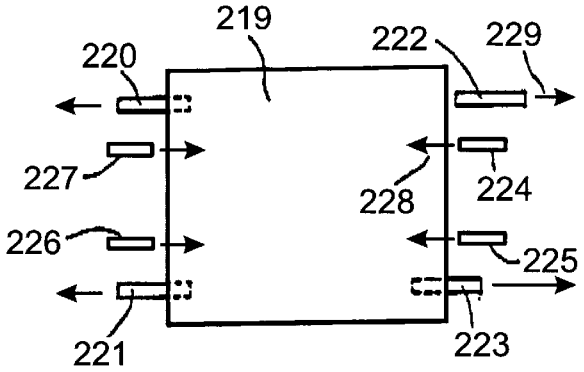
FIG. 29 shows, in a horizontal view, lengthwise displaceable feeding parts of a telefax message in question.

FIG. 29 shows the feeding function for a fax message according to one of the FIGS. 27, 27*a* and 28, 30 respectively. In the case according to FIG. 29 the fax message has been given the symbol 219. In the telefax apparatus or the additional equipment the fax message can be fed by means of rolls or pulleys, 220, 221, 222, 223. The fax message is thus fed during rotation of the pair of rolls. At the sides, e.g. in magazines not particularly shown, strips or pieces 224, 225, 226, 227 are feedable in the direction of the arrows 228. Similar to the pieces described above said pieces have joining means on both sides and in a corresponding way the joining means (glue, paste, etc.) are activatable by means of heat. When said pieces 224–227 are inserted at the edges of the fax message (cf. FIG. 28) the pair of rolls 220–223 can be displaced in lengthwise direction or be displaced in their rotation axises in the direction of the arrow 229. During this displacement the pairs of rolls go free from the telefax papers and the pressing functions of the FIGS. 27*a* and 30 can be effectuated.

In one further embodiment the fax paper 230 co-operates with the paper 231 that has joining means on both sides, similar to the papers described above. When the paper 231 has been infed in the direction of the arrow 232 so that it covers parts of the fax paper 230 or the edge of the fax paper 230 with a thin strip 231*a*, the section 231*a* in question is sheared off by means of a shear apparatus 233.

Figure 32:
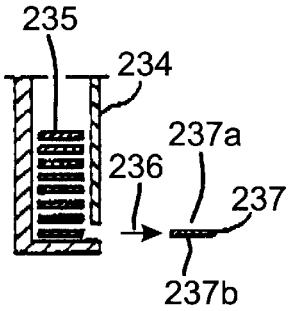
FIG. 32 shows, in a vertical view, a magazine for strips meant to be applied on the edges of the telefax message and presenting glue or the like on both sides.
Figure 33:
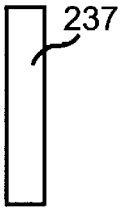
FIG. 33 is showing a horizontal view of a strip according to FIG. 32.
Figure 34:
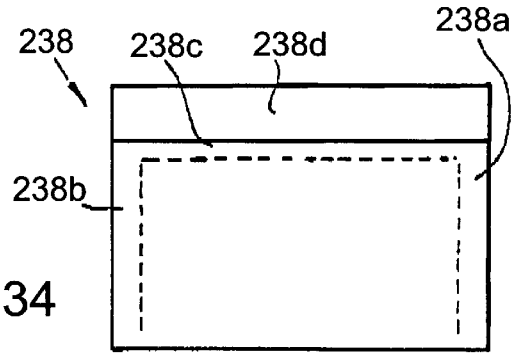
FIG. 34 is showing, in a horizontal view, the enveloped message according to FIG. 30.

It is also possible to have a magazine 234 according to FIG. 32, which magazine is meant for pre-sheared strips 235 that are fed from the magazine in the direction of the arrow 236. Such an outfed strip is indicated with 237 and the strip has surfacings on both its sides 237*a* and 237*b*. The horizontal extent of the strip is shown in FIG. 33. FIG. 34 is a horizontal view showing the folded or enveloped fax message according to the principles of FIG. 28 and FIG. 30. The upper part 214*a* can be given different, required lengths to increase or decrease the space for information classed as secret of the telefax message, i.e. the information between the sides 214*b* and 214*c* of FIG. 30. In FIG. 34 the fax message has been given the symbol 238 and its edges, which are fully or partially glued together, have the symbols 238*a*, 238*b* and 238*c*. In accordance with the aforementioned the fax message can be provided with perforations in the indicated way, by means of which perforations the tearing off of the edges that have been glued together is facilitated.

The invention is not limited to the embodiment shown above by way of example but can be modified within the scope of the following claims and the concept of the invention. One, two or more foldings can be combined with the sealing by mechanical means (anchorings) and perforations (of edges).

THE EMBODIMENT ACCORDING TO THE FIGS. 35–51

Figure 35:
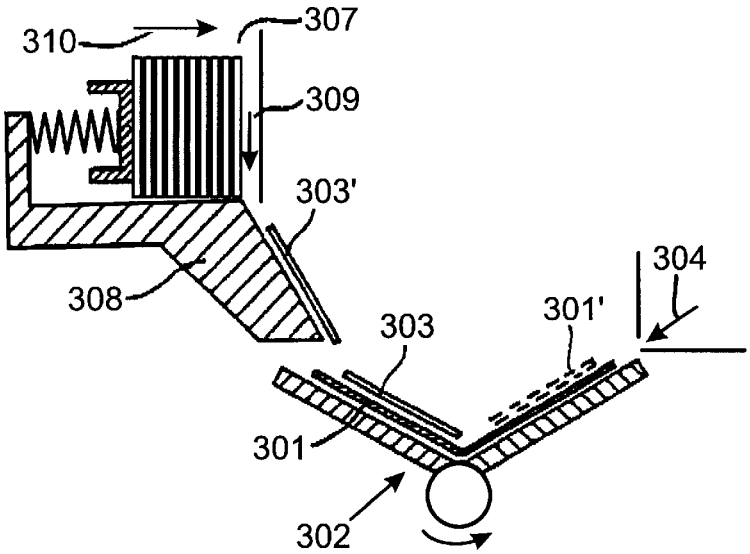
FIG. 35 is a side view showing a magazine for joining members and a folding device for fax messages.
Figure 36:
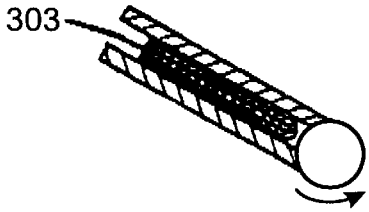
FIG. 36 is showing the folding device in a closed state.
Figure 37:
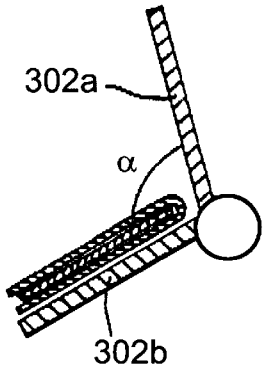
FIG. 37 is showing the folding device in an open state.

In accordance with the FIGS. 35, 36 and 37 the folding function for the fax message is employed at the same time as a joining paper or a joining member which is provided with glue or the like along its edges on both sides is inserted between the folded fax message pages. According to FIG. 35 each fax message 301 is fed down into a folding device 302. Thereby one or more fax messages can be fed down into the device in a successive order. A joining member 303 is fed down over one of the fax message papers, which is slightly prefolded. The direction of the downfeeding of each fax message respectively is indicated with 304 and the direction of the downfeeding of each joining member respectively is indicated with 309. The joining members are arranged in a magazine 307, which in the present case is located above the folding member 302 so that one can use the weight of each message respectively. Therefore there are directing devices 308, for the directing of each joining member 303' respectively to the right position. The magazine principle of 307 can be accomplished in a way known per se. As feeding takes place the joining members are moved in the direction of the arrow 310. Thus, first a fax message 301 can be fed down into the folding device, after which a joining member is fed down on or over the page in question. Thereafter, a second fax message can be fed down over the preceding fax message and over said joining member, after which a new joining member is fed down over one side of the second fax message, etc. In FIG. 36, from the pre-folded state of FIG. 35, folding has been completed until a fully folded state exists. In this state the fax message pages are compressed towards each other with the joining member positioned in between. The clamping can be done with a possible adding of heat. In FIG. 37 the two parts 302*a* and 302*b* have been given a separated position in relation to each other, the separated position having the angle $\alpha$. Thereby the inclination is such that the completely folded, enveloped message can be led away via an outlet opening.

Figure 38:
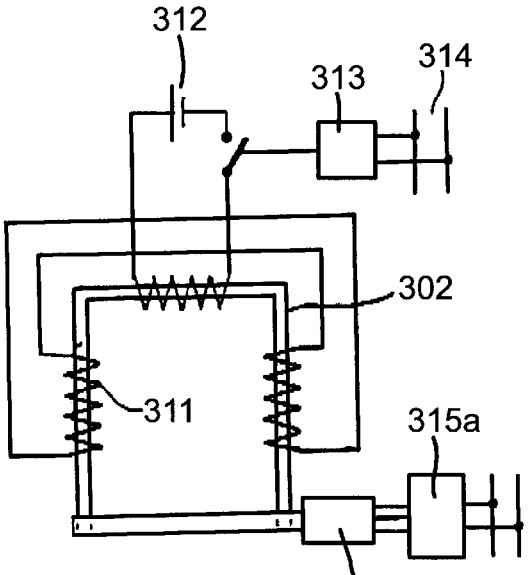
FIG. 38 illustrates a yoke-shaped folding part with heat generating members.
Figure 39:
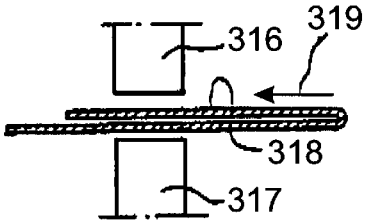
FIG. 39 is showing punching members for the fax message.
Figure 40:
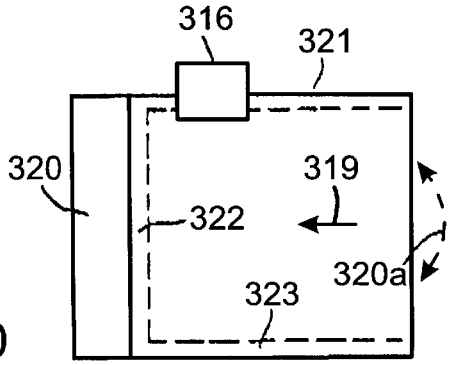
FIG. 40 is illustrating one of the punching members in FIG. 39 in an elevational view.
Figure 41:
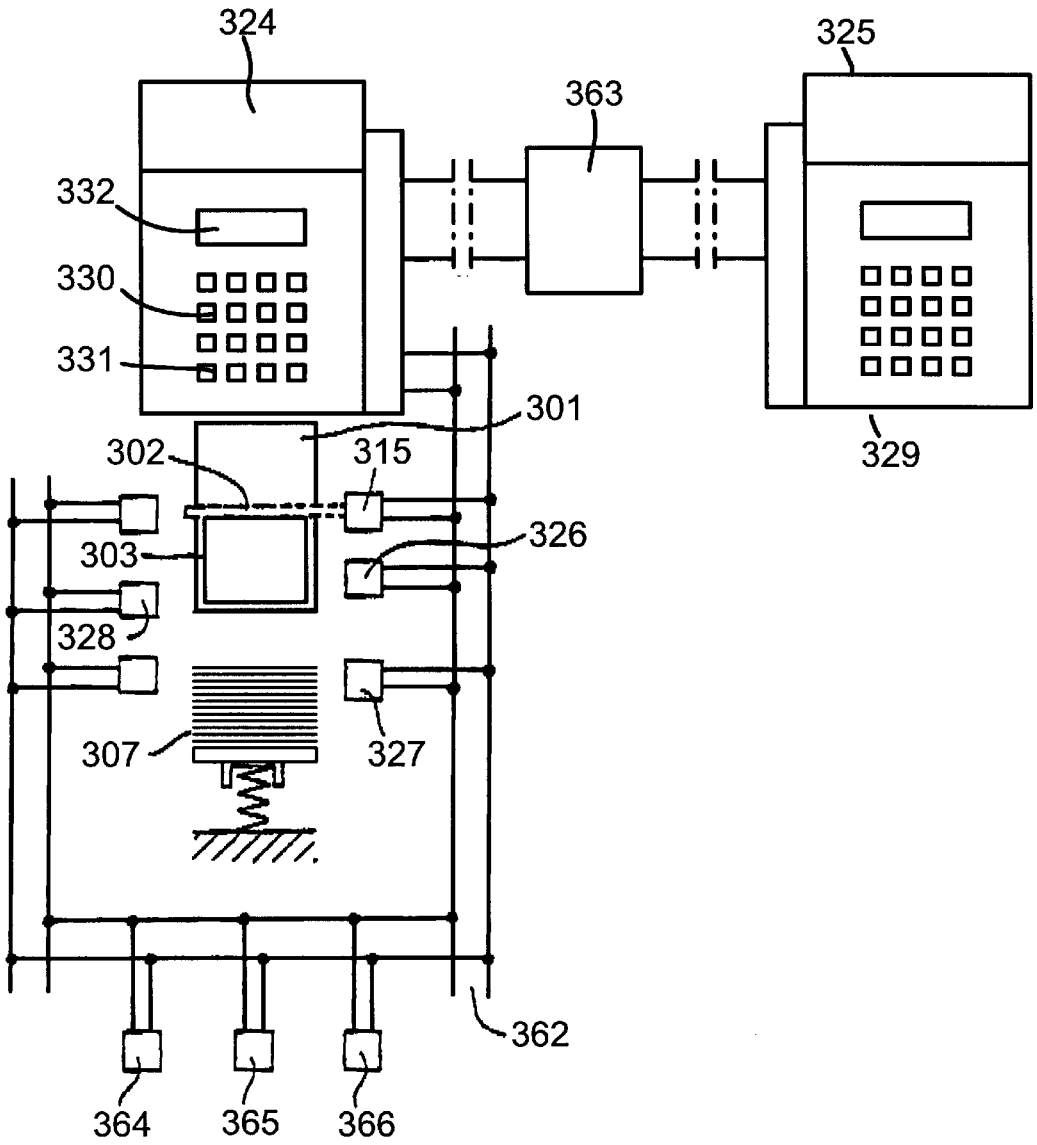
FIG. 41 is a principal view of an equipment according to the invention with communicating fax apparatuses.

According to FIG. 38 the folding part 302 can consist of a yoke which is heatable by means of heat effectuating members 311. The power supply is indicated with 312 and control members for the connection of the power supply are indicated with 313. The connecting lead to the control member 313 is indicated with 314. A motor 315 is shown in FIG. 38 and the motor is arranged to give the folding parts 302*a* and 302*b* their angled positions in relation to each other, as well as their coordinated angled positions. A member for the control of and power supply to the motor 315 is indicated with 315*a*. FIG. 39 shows punching members 316 and 317. The message 318 can be displaced in the direction of the arrow 319 as the punching continues. FIG. 40 shows a horizontal view of the folded message including the space 320 for address. The punching part 316 is shown in FIG. 40 and the feeding directions 319 and possible turning directions 320*a* are also shown. Thus, punching can occur along the edges 321, 322 and 323. In the system of FIG. 41 known fax apparatuses 324 and 325 are employed. The magazine of FIG. 1 is also shown in FIG. 41 as well as the fax message 301 and the joining member 303. The positions of the fax papers, parts executing the folding function, punching members, etc. are detectable by means of one or more detectors or sensors 326, 327, 328, etc. The BUS-connection is indicated with 362.

In FIG. 41 the folding device is schematically implied at 302 and the driving motor of the latter is indicated with 315. A communication connection between the two fax apparatuses is indicated with 363. in the case with regular fax apparatuses the connection 363 is formed by the regular telecommunication network. If, on the other hand, the apparatus 324 and 325 are local stations for electronic mail or the like, the connection 363 may be formed by a local data communication network, but also here the connection may be formed by a more extensive data communication network or the very telecommunication network.

In FIG. 41 the symbol 364 indicates a treatment unit (CPU) while 365 and 366 indicate memory units, for instance RAM and ROM.

The fax apparatuses can be of a sort known per se. Each additional equipment respectively is not especially shown in the figure but can be made in a way known per se so that enveloping and other treatment of each fax message respectively takes place inaccessibly from the outside. Key functions and the like can be of a known sort. Each fax apparatus respectively may comprise a key set and a display unit. A transmitting apparatus may comprise a manoeuvring member, e.g. the key 329, by means of which information is transmitted into the apparatus 324 as to whether enveloping shall be able to take place. The apparatus 324 shall in its turn be able to tell the apparatus 325 that it can receive and envelop the required message. In accordance to signalling received from the apparatus 325 concerning the wish to envelop the apparatus 324 shall also affect the control unit and initiate and carry through the enveloping. In present cases the signal exchange or the protocol are accomplished according to standards (CCITT; 609). As to employed fax protocol within CCITT for the signalling is referred to G3 (and possibly G2) under the fax protocols for use in the context. It is possible to introduce signal outside the protocol. The exchange can be accomplished with Baud-numbers permitted by the connection and determined by the protocol (e.g. 1200, 2400 etc. Baud). With the key set 330 the user of the fax apparatus 324 can program his requests as to the enveloping function. The apparatus 324 also can be provided with an activation key, e.g. 331, with which there are possibilities to engage and disengage the enveloping. The signal exchange can be supplemented with show of information on the display unit 332. The possible control and microcomputer circuits of the fax apparatus itself can be employed. In the present case employment of a separate control unit is suggested, which separate unit can be built into and integrated with the rest of the function of the fax apparatus. Thereby the enveloping possibility can be sold and marketed as additional equipment or as a part integrated in a fax apparatus.

Figure 42:
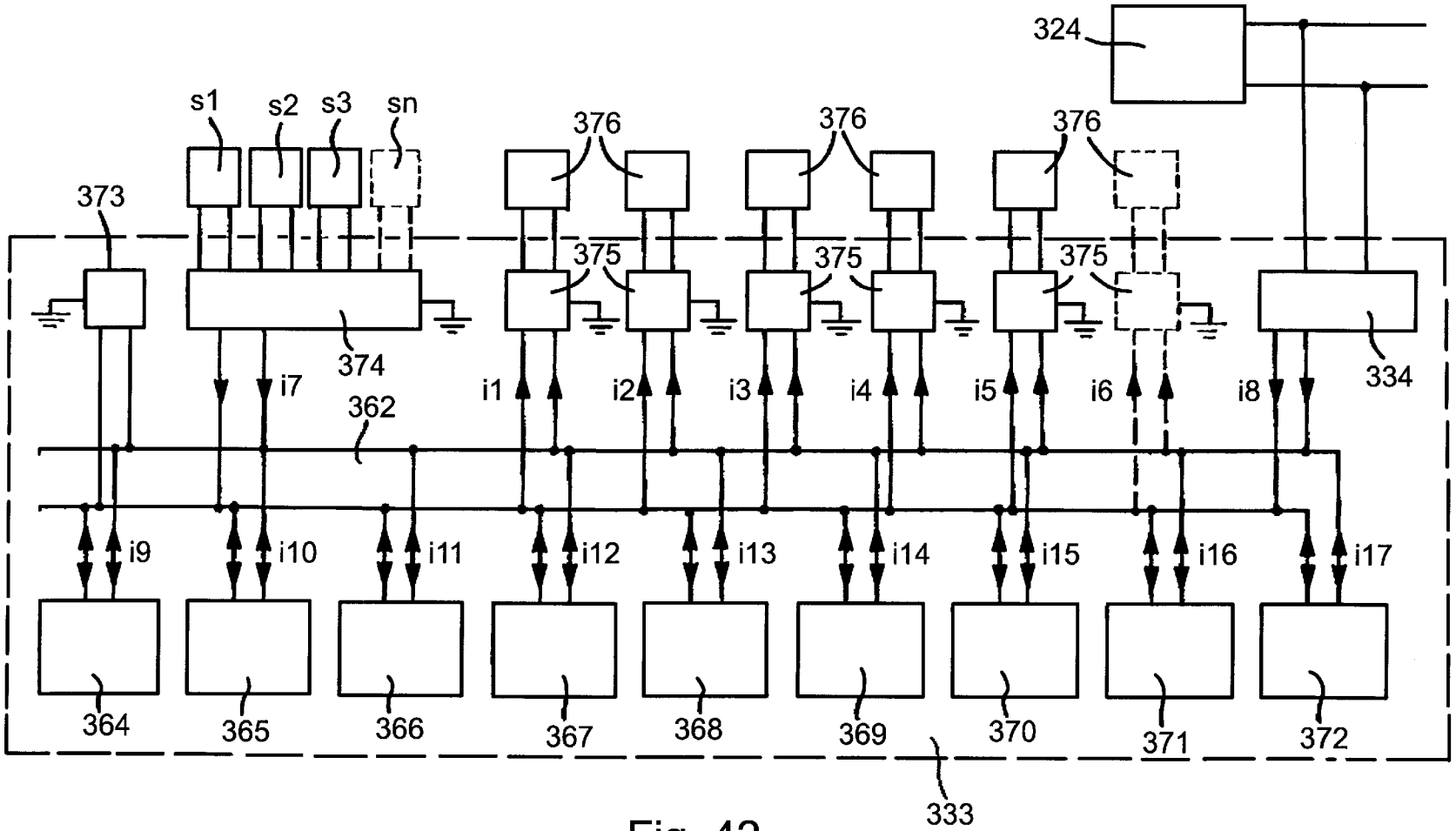
FIG. 42 is showing, in a schematic form, a control unit for the equipment according to FIG. 41.

The parts included in the control unit can be arranged in accordance with FIG. 42, in which the control unit has the symbol 333. The control unit comprises a microcomputer CPU 364 with belonging memory members RAM and ROM 365 and 366 respectively. Furthermore, memory space 367 can be comprised in or outside said memory members for mutual movements between the members in question which are accomplishing or executing the enveloping function. Furthermore, spaces 368 for common movement functions can be comprised in said accomplishing or executing members. In those cases when heat is employed in connection to the sealing an on-off-function 369 may be arranged. Also punching and/or pressing functions 370 can be arranged in memory spaces. Co-ordinated movements 371 as to lengthwise displacements of the parts involved, the fax message or the fax messages, etc., can be comprised in the memory spaces. In the case when two or more fax messages are to be involved in the enveloping function where each fax message respectively is comprised in the sealing, memory members 372 can be arranged for this. The control unit comprises a power supply connection 373. Also adapter units 374 for the sensors S1, S2, S3 . . . S12 are comprised.

Further, adapter members 375 for members executing operation as well as members 376 executing movements and functions are comprised. The microcomputer accomplishes control functions i1, i2, . . . i6 for the different members executing functions and operations, in accordance with detecting functions i7 from said sensors. Furthermore, control and detecting information i8 is obtained from the control and/or fax apparatus adapter unit 334. The calculation circuits of the microcomputer can operate with known programs for control and detection of members executing function courses and sensors respectively and detection of control signals from the tele coummunication system and/or the fax apparatus. Of course, unique calculation functions may be comprised in the operation of the microcomputer CPU 364. Exchange of signal information between the microcomputer CPU and the possible microcomputer of the fax 324 may also occur. The signal exchange of the microcomputer is indicated with i9. The signal exchanges to the different memory function units are indicated with i10, i11 . . . i17. The BUS-connection 362 can be comprised by a connection with two or more threads. Thereby, communication protocols are present between the adapter circuits and the members executing function courses. In one or more points executing or carrying out functions another microcomputer may be arranged, the micro computer forming a slave unit to the microcomputer 364 and/or the microcomputer of the fax 324. Thereby, the microcomputer at the executing point can be provided with a known program for the function execution in question, and thereby receives only one superior control information, program feeding, etc. from the master microcomputer. It is referred to the embodiments according to the enclosed patent claims.

Figure 43:
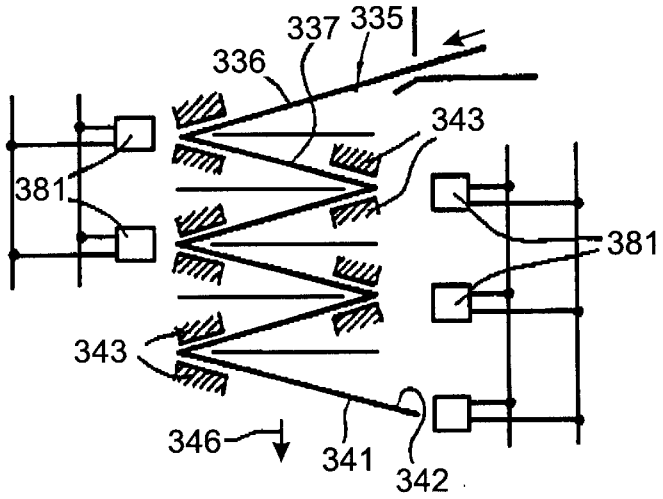
FIG. 43 is illustrating a folding device for a fax message in the form of a continues paper web.
Figure 44:
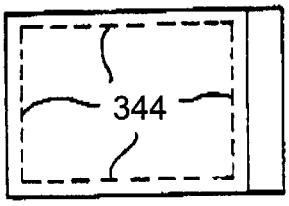
FIG. 44 is showing a fax message in an elevational view after folding.
Figure 45:
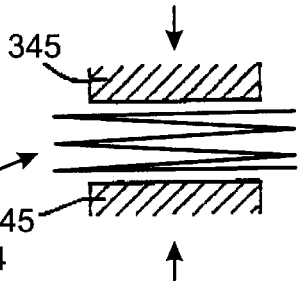
FIG. 45 is showing pressing and/or punching members for a web of fax messages.
Figure 46:
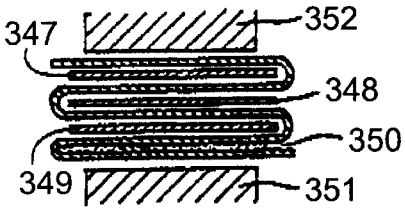
FIG. 46 is illustrating how the folding and joining function can be supplemented by joining members.
Figure 47:
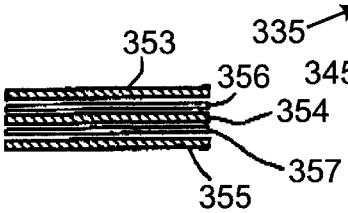
FIG. 47 shows how the web has been cut into parts or fax messages with joining members between themselves, FIG. 48 schematically shows an alternative methodology for the folding of fax messages, FIG. 49 schematically shows an equipment with communicating fax apparatuses with enveloping-determining affecting members.
Figure 48:
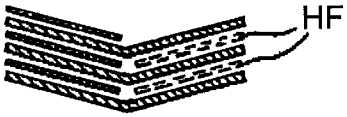
Figure 50:
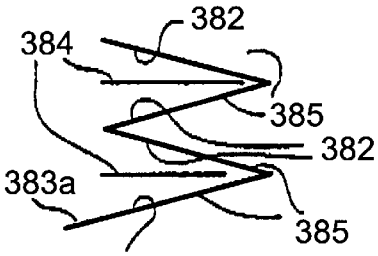
FIG. 50 is illustrating a further web folding method.
Figure 49:
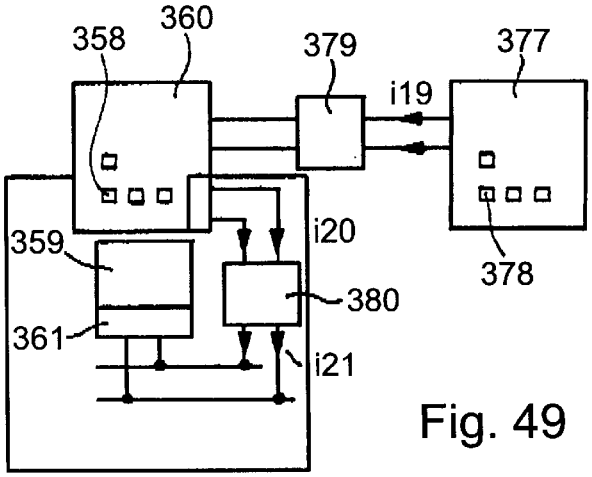
Figure 51:
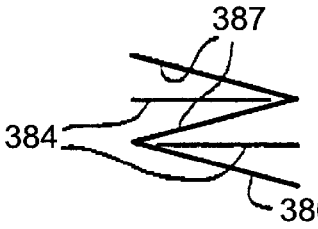
FIG. 51 is showing another folding methodology.

In one embodiment the fax message has the shape of a continuous paper web, which, in itself, comprises several fax messages (compare with FIG. 43). The paper web is folded successively or generally simultaneously in the transverse directions, preferably in the beginning and at the end of each fax message respectively. Thus, the paper web 335 comprises individual fax messages 336, 337 . . . 341. The folding is also done on the address space 342 and exists on the lowermost fax message 341 or the last fax message 336 from the apparatus. At each folding location respectively folding effectuating or paper web treating members 343 are arranged. Sensors 381 according to the aforesaid are connected at their folding or treatment point. A paper web folded in this way can be sheared by a receiver by means of a scissors or cutting function along shearable edges 344. In FIG. 45 pressing and/or punching members 345 are shown and are compressing the paper web 335. A feeding direction for the paper web in FIG. 43 is indicated with 346. The joining function of FIG. 45 can occur in accordance with what has previously been described. The folding function and the joining function can also be supplemented by joining members 347–350 according to FIG. 46. Here, the punching and/or pressing members have the symbol 351, 352. According to FIG. 47 the paper web can successively be sheared off into paper web parts (fax messages) 353, 354 and 355. Joining members 357, according to the aforesaid, are arranged between the fax messages. For instance, said joining members have glue surfacings on both sides along their edges. According to FIG. 48 first, second and third fax messages can be pre-folded and joining members can be laid over the fax messages thus having been pre-folded, the fax messages thereafter being folded one at a time. According to FIG. 49 a transmitting fax apparatuses 377 is provided with affecting members 378 to tell whether enveloping is to take place or not. Furthermore, affecting members 378 to tell about the No. of fax messages are comprised. In accordance with the affections of the affecting members signals i19 are received by the first fax apparatus 360 via the communication system 379. In the case when enveloping is to take place, the apparatus generates initiating signals i20 to the microcomputer CPU 380. Alternatively the information as to whether enveloping is to take place or not can be determined from the first fax apparatus by means of affecting members 358 thereon. Thereby, said initiating information i20 is generated in a corresponding way. In accordance with the received information CPU generates affecting signals i21 to a paper web 359 which starts from a unit 361 that affects the fax 360. Cf. FIG. 43. In FIG. 48 folding can take place simultaneously by employing further joining members HF between the second paper halves or corresponding sheet parts. The folding of a paper web can lead to a standardised No. of sides in the envelope, which sides can be employed or not. In FIG. 50 for instance, four sheets of paper on which the text sides are indicated with 382 are comprised. The uppermost and lowermost text sides are turned inwards and the lowermost side 383 has a projecting part 383*a* for addresses and information. Thereby, the standardising can be added with odd numbers of foldings, said foldings being one or more. Joining means or members are indicated with 384. The backsides of the web, i.e. those lacking text, are indicated with 385. In the embodiment of FIG. 51 the lowermost text side 386 is turned outwards and is employed as an address and information side while the remaining text sides 387 are turned inwards. The joining members are indicated with 388. In this case the No. of foldings is even. The standardising can be based on two or more even foldings.

THE EMBODIMENT ACCORDING TO THE FIGS. 52–68

FIG. 52

401. Infeeding a document

402. Outfeeding an unaffected document.

403. Outfeeding a sealed document.

404. Optical sensor.

405. Optical sensor, movable in the plane of the document.

406. Optical sensor, movable in the plane of the document.

407. Driving roll with friction lining, e.g. rubber.

408. Driving roll with friction lining, e.g. in sections.

409. Driving roll with friction lining.

410. Driving roll with friction lining.

411. 5 pressure rolls.

412. Compression spring pressing 411 against 407, 408, 409 and 410.

413. Folding knife

414. 2 traction springs, one at each end of 413.

415. Punch and knife holder.

416. 9 punches, thickness of -3 millimetres and width of -5 millimetres.

417. 9 knives, thickness ≈0,5 and width ≈4 millimetres.

418. Stripper

419. Spring that presses the stripper downwards towards interceptors, in a known way for pressing tools.

420. Die, here shown in section C—C in FIG. 53.

421. 2 crank disks.

422. 2 crank shafts.

423. 3 inserters, positioned right below the punch rows.

424. 3 traction magnets.

FIG. 53

425. Electric motor with gear box.

426. Driving belt.

427. Gear wheel.

428. Driving belt.

429. Gear wheel.

430. Electric motor with gear box.

431. Driving belt.

432. Traction magnet.

433. Yoke.

434. Ball bearings fixed on 433.

435. 4 guide pins, fixed in 420 and running accurately in holes in 415.

436. 9 openings for a punch 416.

437. 9 openings for a knife 417.

418. Cutting surfaces together with a punch 416.

FIG. 54

Figure 52:
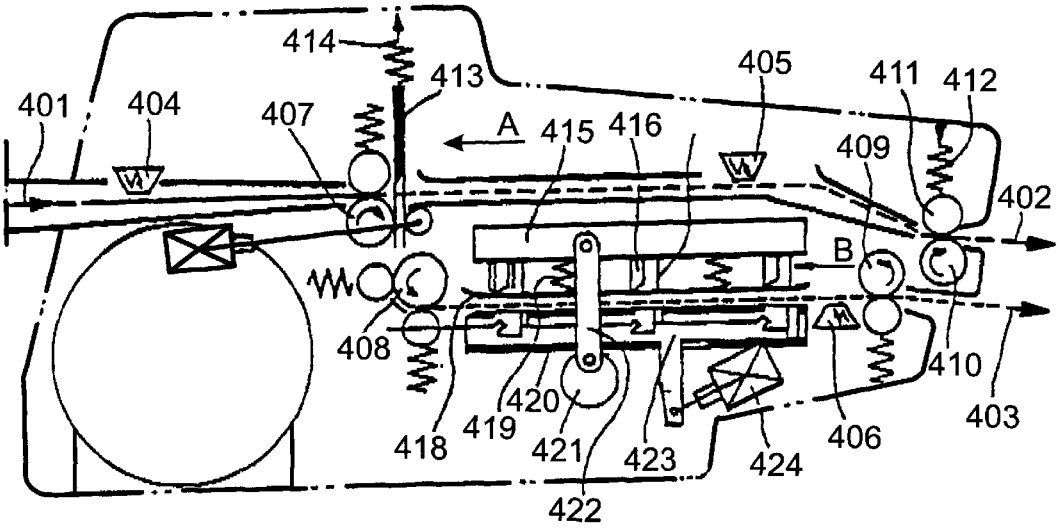
FIG. 52 is a schematical side view illustrating an enveloping device according to the invention.

Showing the folding knife 413 according to view A, FIG. 52.

439. Recesses so that the folding knife 413 can be brought down beyond the contact line between the driving roll 408 and the pressing roll 411 thereof (FIG. 53) without touching the sections of friction material of the driving roll 408.

440. Stop for 413.

Figure 53:
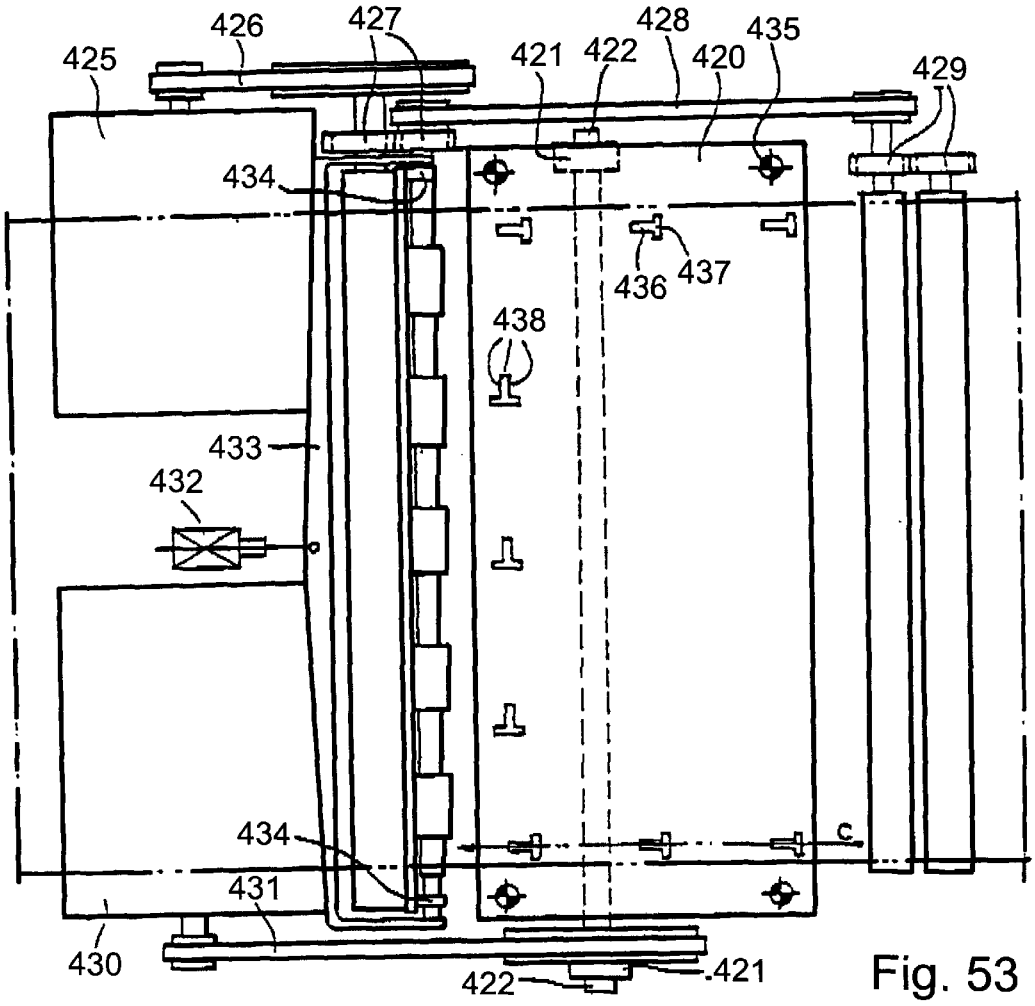
FIG. 53 is a view of the device according to FIG. 52, seen from above.
Figure 54:
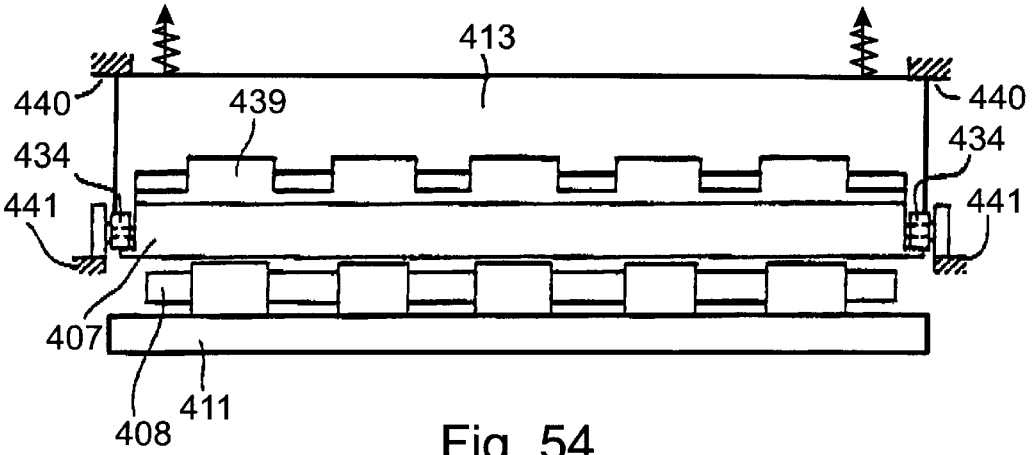
FIG. 54 is a detailed view, seen in the direction of the arrow A of FIG. 52.

441. Stop for yoke 433. (FIG. 53).

FIG. 55

Showing knife 417 according to view B, FIG. 52.

442. Opening in the knife 417, wider than the punch 416.

443. Lip.

FIG. 56

Showing the stripper 418 according to the view D, FIG. 4.

444. Opening for the knife 417 ≈1 millimetre wider than the thickness of 417.

445. Opening for the punch 416.

FIG. 57

Showing how the folding knife 413 has brought the document 446 down between the friction surfaces of the driving roll 408 and the pressing roll 411.

417. Relinking rail.

FIG. 58

Showing an unsealed document with bar code 448.

FIG. 59

Showing how the crank discs 421 have brought down the punches 416 and the knives 417 into the die 420 by means of the crankshafts 422 and have penetrated through the folded document 446.

FIG. 60

Figure 59:
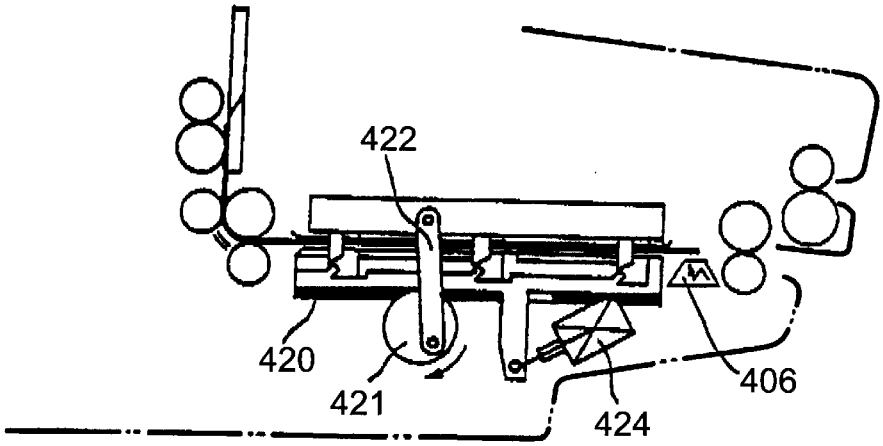
FIG. 59 is a detailed view illustrating a stage of the punching of a folded document.
Figure 60:
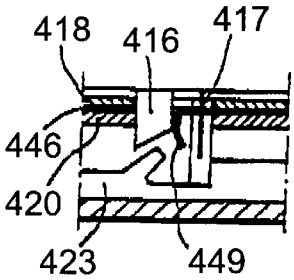
FIG. 60 is an enlarged view of a punch and knife unit according to FIG. 59, FIGS. 61–63 are different views illustrating the forming of flaps and insertion of those same into a locking engagement.

Showing an enlargement of a punch/knife unit in FIG. 59.

449. is a document flap which has been cut loose by the punch 416.

FIG. 61

Figure 55:
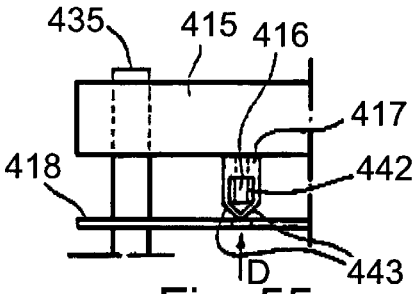
FIG. 55 is a detailed view, seen in the direction of the arrow B of FIG. 52.
Figure 56:
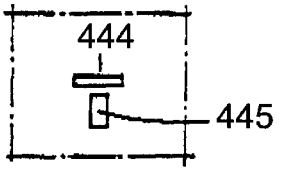
FIG. 56 is a detailed view seen in the direction of the arrow B and showing a stripper.

Showing how inserters 423 have inserted the flaps 449 through the opening 442 (FIG. 55) in the knife 417.

FIG. 62

Showing punches and knives on their way up, in a state where strippers 418 are to leave the document and the flaps 449 are positioned in a loose way against the lower edge of the opening 442 in the knife 417.

FIG. 63

Showing the upper part of the sealing device in a fully open position.

FIG. 64

Showing a threaded pair of flaps in enlargement.

FIG. 65

Showing the first page in a transmission.

FIG. 66

Showing the following pages.

FIG. 67

Showing a "fax letter".

451. Stamp.

450. "Dry glue". Glue in micro balloons, that burst at a suitable pressure.

Function

The document is inserted at 401. When the document passes an optosensor 404 the motor 425 starts and drives the driving rolls 407, 408, 409 and 410 via the belt 426, gear wheels 427, belt 428 and gear wheels 429. The driving roll 407 brings the document to the optosensor 405, and, if this one is put out of function, e.g. by means of a switch which is positioned on the apparatus and accessible from the outside, or via a bar code or in any other way, the document is brought out at 402 by means of a driving roll 410.

Figure 57:
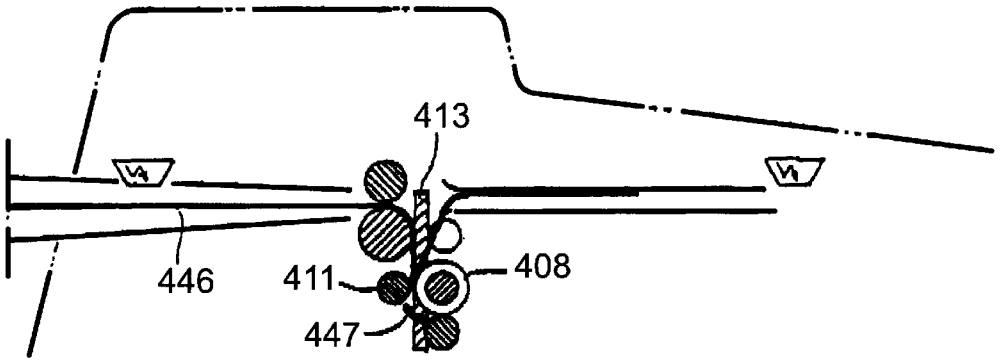
FIG. 57 is a detailed view illustrating a stage of the folding procedure.
Figure 65:
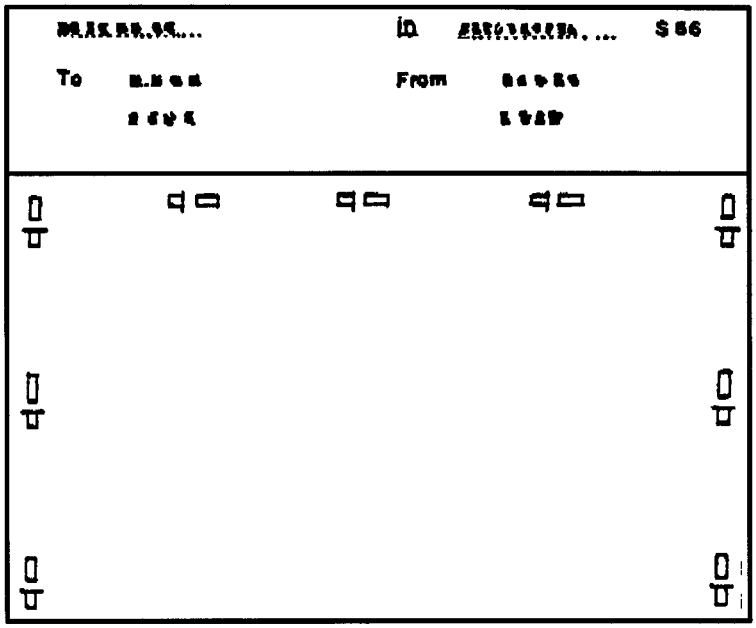
FIG. 65 is an elevational view of a first page of a transmission.
Figure 66:
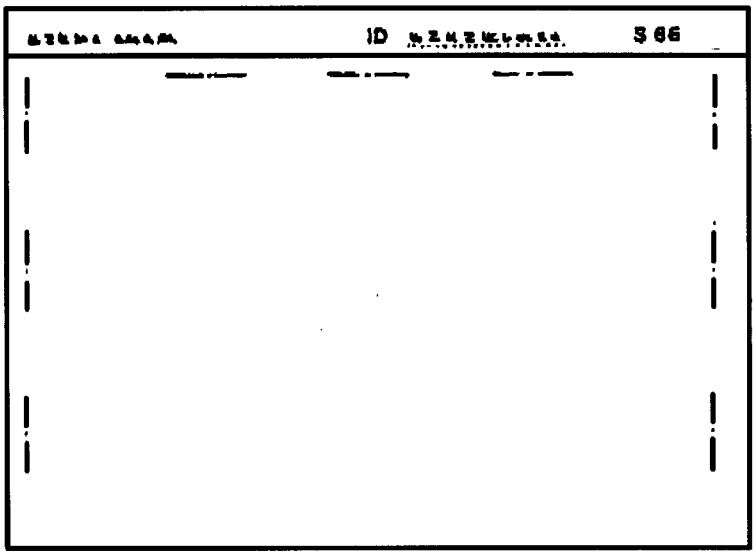
FIG. 66 is an elevational view of the following pages.

If a sealed document is requested, the optosensor 405 activates traction magnets 432, which via the yoke 433 presses the ball bearings 434 towards the folding knife 413, so that this one, in its turn, is pressed towards the driving roll 407 and is brought down by the friction forces so that the document is folded according to FIG. 57. Further sensors can be positioned after 405, so that the sensor 405 folds the document in accordance with FIG. 65 and the next sensor folds the doucment in accordance with FIG. 66.

Figure 58:
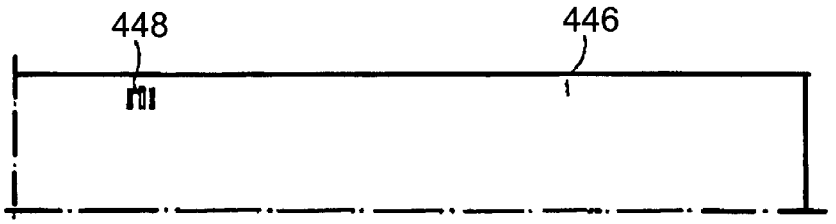
FIG. 58 is an elevational view of an unsealed document with a barcode.
Figure 61:
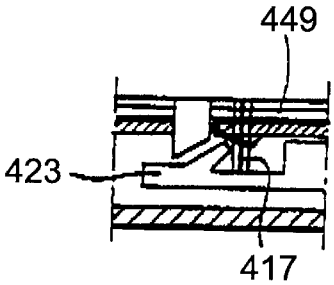
Figure 62:
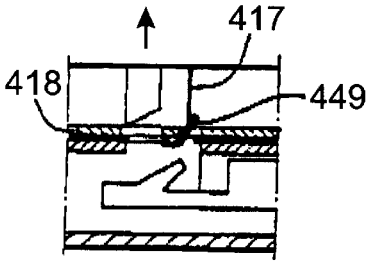
Figure 63:
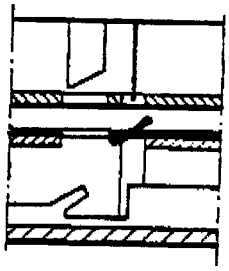
Figure 64:
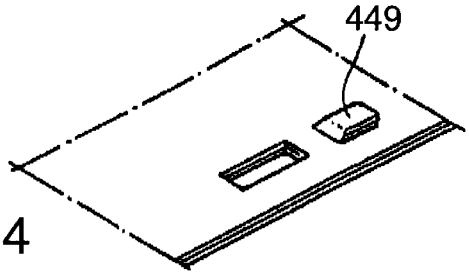
FIG. 64 is an enlarged view of a threaded pair of flaps.

Another way of determining where the document is to be folded is to provide the latter with a code, e.g. a bar code (FIG. 58). In the first place, by being present or not, the code indicates if the document is to be folded, in the second place where it is to be folded. If sensors are placed at both sides of the document, the latter can come with turned ends and yet be sealed correctly. After the folding, the document is forwarded, gets further help by the driving roll 108 and is linked 900 by means of a rail 447, is brought in through the sealing part all the way to a sensor 406, which stops the motor 425 and starts the motor 430, which, via the driving belt 431, turns the crank disks 421 to a position according to FIG. 59. The outcutting of the flap (flaps) has now been done according to the figure description and at further turning of the crank disks 421 the contraction magnet 424 is activated, so that the inserters 423 insert the flaps 449 through the knife 417 according to FIG. 61. At the upward movement of the knives, the flaps 449 are brought double folded through the slots in the document, said slots being made by the knives 417, and then they are brought on through the openings 444 of the stripper 418, to run out from the openings 442 of the knives 417 at a position according to FIG. 62. At a further upward movement the stripper 418 leaves the document and the motor 430 stops when the crank discs have moved 360°. The traction magnets 424 goes back to an initial position together with the inserters 423 by means of springs (not shown). The motor 425 starts and brings in the document between the pair of rolls 409 and 411, where the flaps 449 are pressed down, the document being sent out at 403, and when the rear end passes the sensor 406 the motor 425 is switched off.

Figure 67:
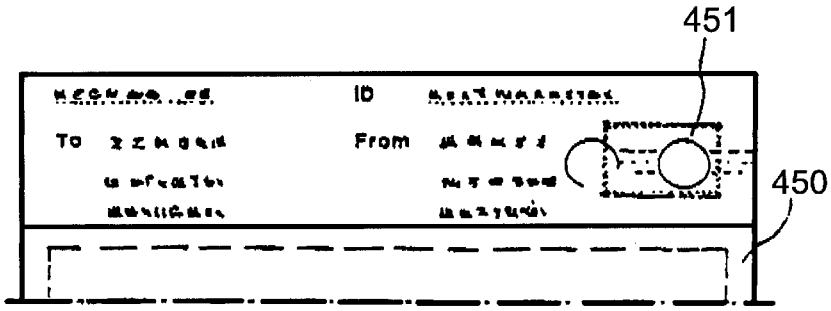
FIG. 67 is an elevational view of a "fax letter"

Another way of sealing is shown in FIG. 67. When using "fax letters" these may perhaps not accept the flap sealing. In such a case the document can be provided with "dry" glue, said glue gluing the document together during passing of the pair of rolls 409 and 411. The sensor 406 is then put out of function, e.g. during charging of the fax apparatus with glue preparated papers, or with a code according to FIG. 58, which also can make the fax apparatus choose preparated papers from a particular magazine.

Figure 68:
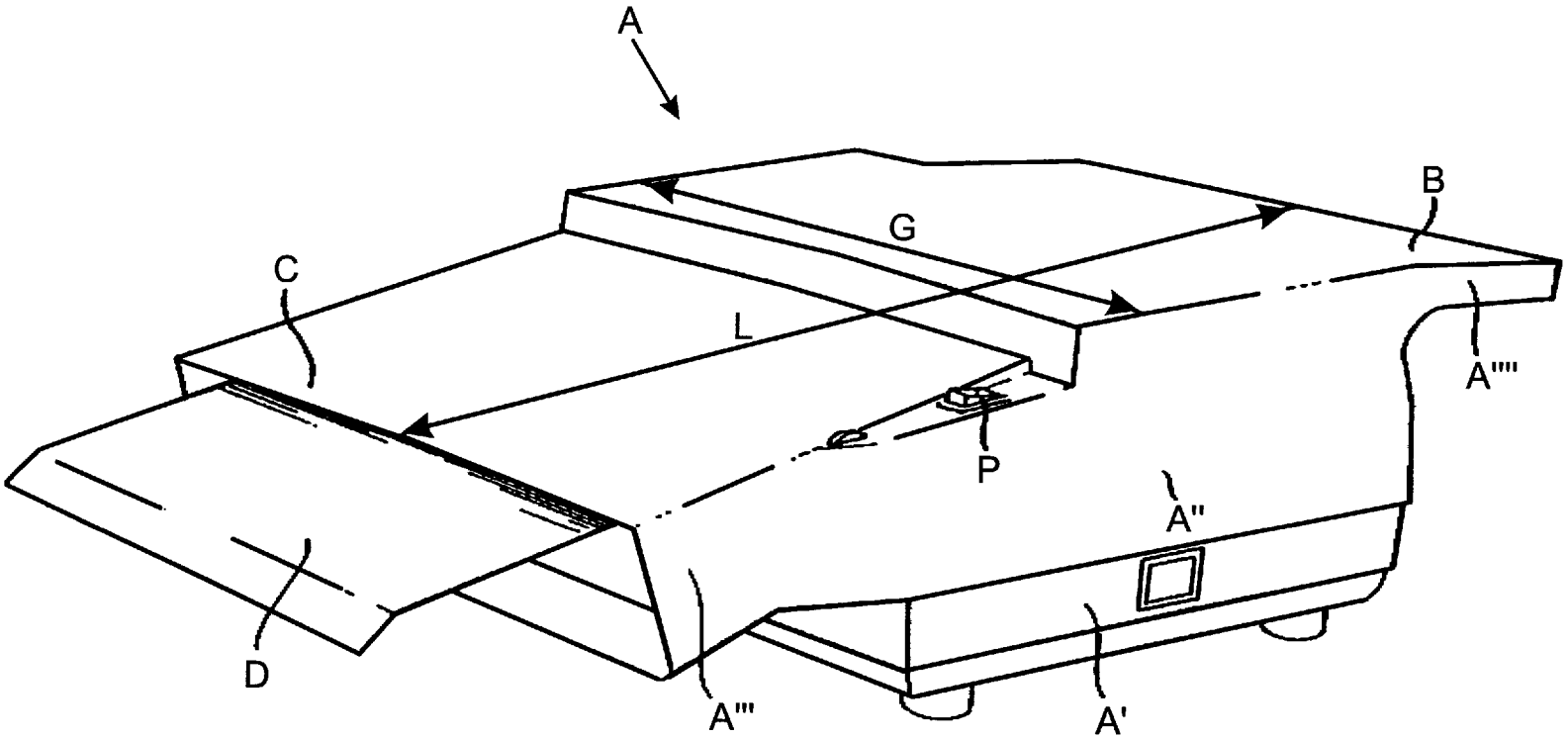
FIG. 68 is a perspective view of an enveloping apparatus according to the invention.

FIG. 68 shows a constructive design of an enveloping apparatus 417 according to the invention, said apparatus being possible to connect and lock to a fax equipment known per se and being sold on the common market. Hereby it can be referred to the apparatus "RICHO 3 000" which is sold by Enström/Carl Lamm. The rear end B is applied to the paper feeding recesses on the known fax or the fax in question. The equipment A shows or may show a length of 35–50 centimetres and a height of for instance 10–20 centimetres. At the front end C cavities are arranged for enveloped documents/printout media D. From a second cavity unenveloped documents/outprint media F or such media enveloped in an alternative way (see above) can be provided. The width G may have values between 25–40 centimetres. Affecting members P have been arranged for the choice of enveloping, non-enveloping, positions for the folding, etc. The apparatus presents a generally rectangular part, a bottom part A' and an upper part arranged with the latter. The upper part comprises a central part A" and sections A'" and A"" projecting from said central part, said sections extending forward and backward respectively. The rear surface of the central part and the lower surface of the section A"" are connected to the known fax apparatus. The front section A"' inclines slightly forward/downward towards the user and the feeding cavities are slightly inclined in relation to the vertical plane directed towards the user.

THE EMBODIMENT ACCORDING TO FIGS. 69–71

Figure 69:
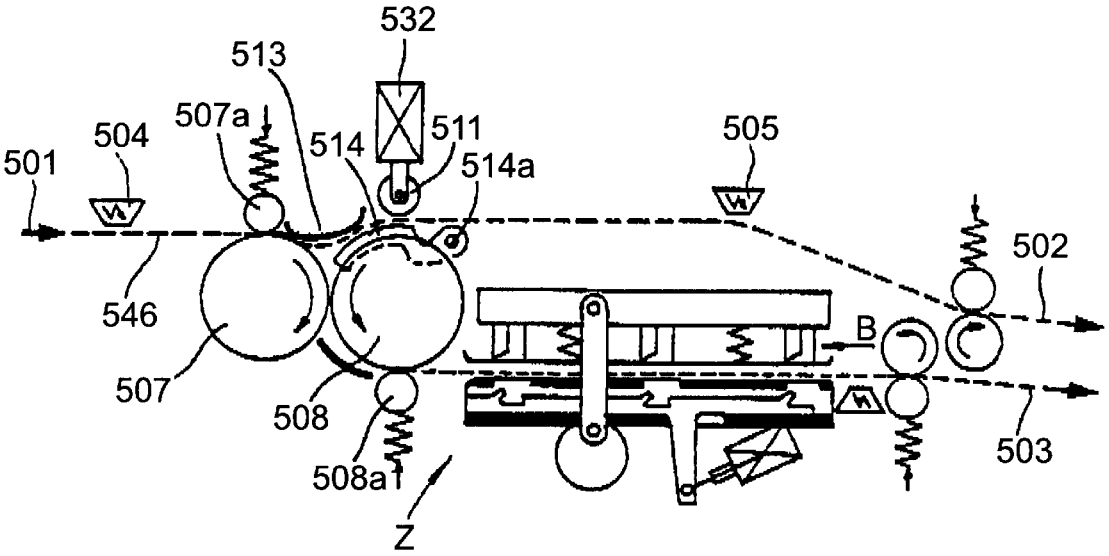
FIG. 69 is a view similar to FIG. 52 but illustrating a somewhat modified embodiment.
Figure 70:
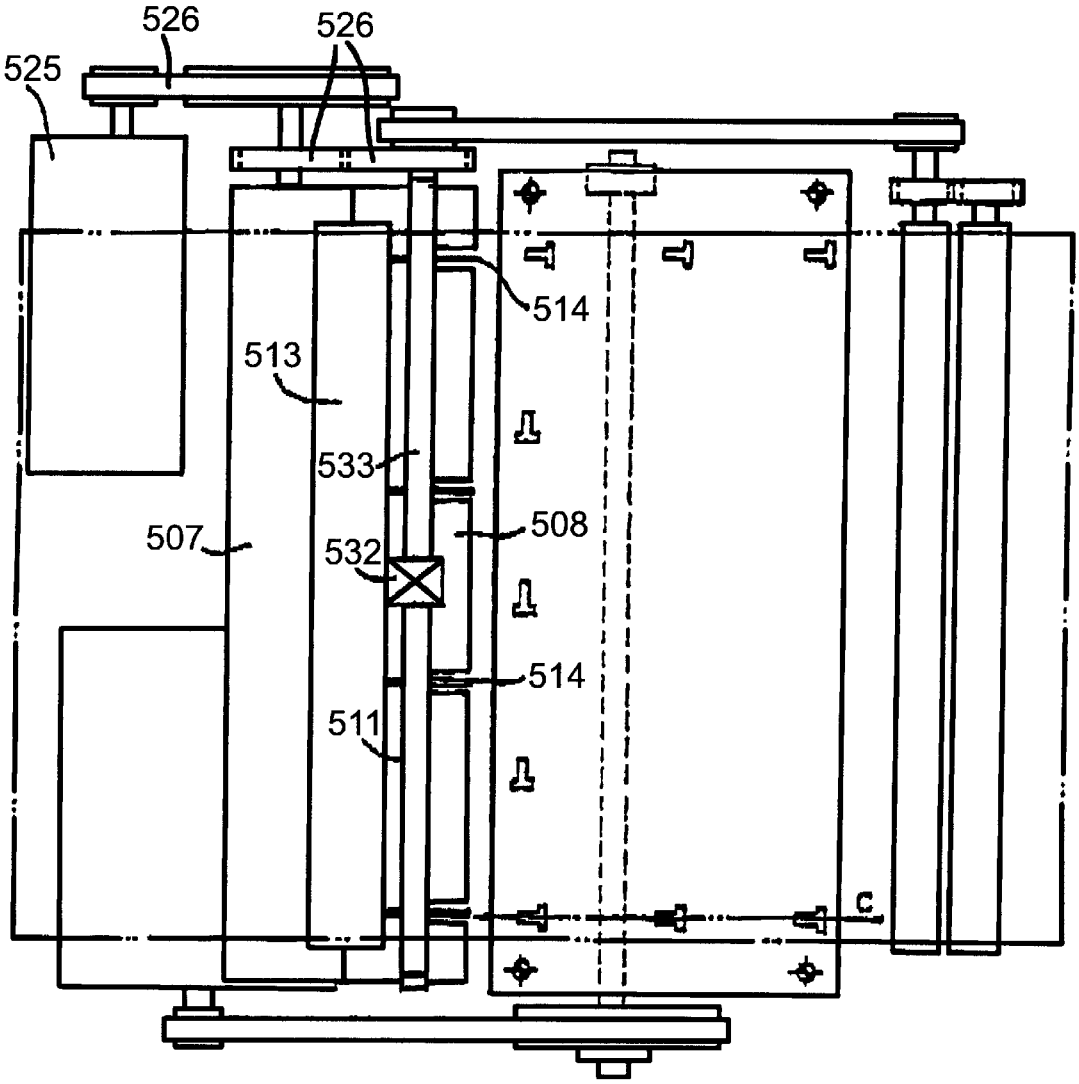
FIG. 70 is a view of the apparatus according to FIG. 69, seen from above.

This embodiment refers to an alternative to the folding device described in the embodiment according to FIGS. 52–68. In FIG. 69, at 501, is indicated how the document in question 546 is meant to come in. As previously, a sensor 504 detects when the document arrives. Feeding members 507 and 507*a* are in engagement with the document web and feeds it forward in the device. These feeding members comprise a driving roll 507, in particular with a friction lining, for instance rubber, and a pressing roll 507*a*, which is pressed towards the driving roll 507. The document web is received between these rolls. One further sensor 505 detects the front edge of the document. Members 514 lifting the document web are arranged to lift the document so that it passes over the driving roll 508 without getting in contact with its periphery, which suitably is provided with friction lining. The web lifting members 514 has the character of arms that are tiltably mounted around a shaft 514*a* and that are received in grooves in the roll 508 in a way shown in FIG. 70.

The driving rolls 507 and 508 are driven in opposite directions and located so that they form a nip between each other, in which nip rolling surfaces which are immediately adjacent are moving downwards. Above this nip a guiding member 513 is arranged, said guiding member having the character of a rail arranged to guide the document arriving from the rolls 507, 507*a* over the web lifting members 514.

Another roll 511 is co-operating with the driving roll 508. This one has the character of a pressing roll and is rotatably mounted in a yoke 533, which is possible to affect with a force member 532, for instance a pressure magnet, so that the pressing roll 511 is pressed downwards against the driving roll 508. The pressing roll 511 is arranged in the area above the web lifting members 514. When the pressing roll 511 is pressed downwards it first reaches the web lifting members 514 and presses these ones downwards into the grooves in the driving roll 508, so that the document web, which is present between the driving roll and the pressing roll, will be pressed until contact with driving roll 508 is obtained.

In the area below the nip between the driving rolls 507 and 508 the guiding member 547 is arranged, said member having as its task to guide a folded document coming out from the nip between the driving rolls 507 and 508 in a direction towards a unit Z for sealing the document sections folded against each other in relation to each other. This unit has been described in detail in the previous embodiment and here it won't be further treated. It shall only be noted that the folded document can be meant to be driven on in this unit by means of a driving nip formed between the driving roll 508 and another pressing roll 508*a*. As in the previous embodiment, unfolded documents are meant to be able to pass through the device and leave the same at the arrow 502. On the other hand, documents that are folded and sealed in the unit Z leave the device at 503.

The driving rolls 507 and 508 are driven as in the previous embodiment, by means of a motor 525 and transmission members 526, 527, e. g in the form of belts/gear wheels or the like.

The device operates in the following way: When documents arriving at 501 not are to be folded the pressing roll 511 is retracted and the web lifting members 514 are elevated so that the document web arriving between the rolls 507 and 507*a* and driven by the roll 507 moves above the web lifting members and below the guiding member 513, to finally leave the device at 502, for instance after having passed through the driving nip between the rolls 410 and 411, as in the previous embodiment.

Figure 71:
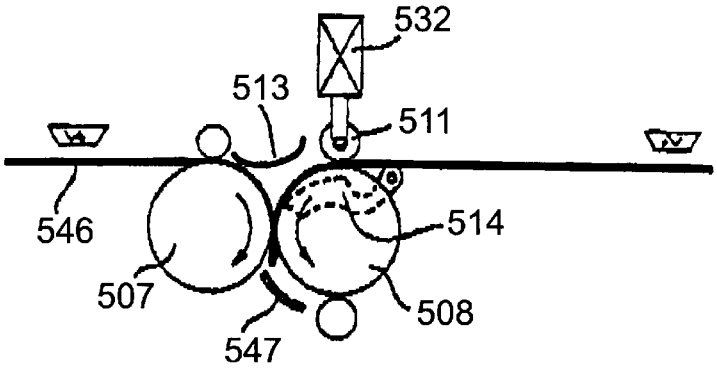
FIG. 71 is a detailed view illustrating a phase of the folding of a fax message.

When, on the other and, an arriving document is to be folded, the sensor 505 indicate when the front edges of the document has reached said sensor, and thereby the pressing roll 511 is activated so that it presses down the document web to contacting against the mantle surface of the roll 508. As a consequence of the rotation directions of the driving rolls 507 and 508, indicated in FIG. 69 and 71, this will give rise to that the document, in a folded state, will be driven downwards through the nip between the rolls, with the fold of the document located at the bottom, as indicated in FIG. 71. Thereby the fold of the document comes in between the guiding member 547 and the driving roll 508 and is linked on into the nip between the latter and the additional pressing roll 508*a* and then goes into the sealing unit Z. After that, the sealed and double folded document leaves the device at 503 after having passed through a driving nip formed by a driving roll and an additional pressing roll co-operating with the latter.

Of course, the devices and methods described can be modified in a number of ways within the scope of the concept of the invention brought to expression in the following patent claims.

In all the described embodiments the general feature of the invention is that the sealed, outprinted telemessage has its text bearing areas sealed all around. On the basis of for instance FIG. 14 this can be clarified to that point that the sealed telemessage 66 illustrated therein has four sealings 67, 68, 69 an 71, two of which 67, 68 extend along opposite edges while another one 69 is transversely directed in relation to the sealings 67, 68 located at the edges. In the example, the sealing 69 is designed to leave the information space 70 free and extends generally parallel with the latter. In the example, the remaining sealing 71 is formed by a folding but could also be comprised of a sealing between two separate sheets of paper.

I claim:

1. An enveloping device for equipment which receives telemessages, said equipment arranged to print out said telemessages on a printout medium with a printout device said enveloping device being connected to said printout device and being arranged to use at least a part of said printout medium in the enveloping enclosure and to seal said printout medium along at least one edge, said enveloping device comprising:

punching members and flap affecting members arranged along three edges of said printout medium, wherein said printout medium is fed to said punching members and said flap affecting members, wherein each punching member comprises a first punching member arranged to make flaps during its function and a second punching member arranged to make an adjacent recess, arranged by the side of a belonging recess centered with the flap during the function of said first punching member, said flap having a connection to the printout medium, said flap affecting members are arranged to take each outpunched flap respectively, into the adjacent recess, so that the flaps are received into the adjacent recess via the bottom side of the printout medium, so that each flap respectively extends from the bottom side of the printout medium at the belonging recess thereof, to the upper side of the printout medium at the adjacent recess.

2. A device according to claim 1, wherein the flap affecting members comprise flap inserters inserting said flap in a recess in punching members effectuating the adjacent recess, and, after the insertion of the flap into the punch recess, the respective flap is pulled up by said punching member and stripping is done by means of a stripper.

3. A device according to claim 2, wherein said flap inserters for all the punching members are affectable by means of a traction magnet.

4. A device according to claim 2, wherein punching members are arranged in first and second holders arranged to be affectable in a direction away from and towards each other in accordance with controls, the punching and flap affecting functions being coordinated with the movements of the holders, so that punching and flap affection are effectuatable during the movements of the holders towards each other.

5. A device according to claim 4, wherein the holders are operable by means of an eccentric function accomplishing the movements of the holders, said movements being directed towards and away from each other.

6. An enveloping device for equipment which receives telemessages, said equipment arranged to print out said telemessages on a printout medium with a printout device, said enveloping device being connected to said printout device and being arranged to use at least a part of said printout medium in the enveloping enclosure and to seal said printout medium along at least one edge, said enveloping device comprising:

means for effectuating sealing of said printout medium cooperating with a feeding arrangement, said feeding arrangement comprising:

a first driving roll included in the feeding members, said first driving roll receiving the printout medium between itself and a second driving roll;

means for lifting said printout medium and, in a first position, leading said printout medium past a third driving roll without folding, said third driving roll being driven in the opposite direction in relation to said first driving roll; and a fourth driving roll, arranged to receive the printout medium between itself and web lifting members and capable of pressing down the means for lifting, said means for lifting being flexibly arranged, so that said printout medium is pressed towards said third driving roll, whereby the document will be folded and will pass down between the driving rolls with its fold first.

7. A system for transmission of electronic mail, said system comprising a first office supplying said mail and a second office receiving said mail, said second office having enveloping equipment for receiving said mail, said equipment arranged to print out said electronic mail on a printout medium with a printout device, said enveloping device being connected to said printout device and being arranged to use at least a part of said printout medium in an enveloping enclosure and to seal said printout medium along at least one edge, said enveloping device comprising:

punching members and flap affecting members arranged along three edges of said printout medium, wherein said printout medium is fed to said punching members and said flap affecting members, wherein each punching member comprises a first punching member arranged to make flaps during its function and a second punching member arranged to make an adjacent recess arranged by the side of a first recess created with the flap during the function of said first punching member, said flap having a connection to the printout medium, said flap affecting members being arranged to take each outpunched flap, respectively, into the adjacent recess, so that the flaps are received into the adjacent recess via the bottom side of the printout medium, whereby each flap, respectively extends from the bottom side of the printout medium at the first recess thereof, to the upper side of the printout medium at the adjacent recess.

* * * * *